US011268727B2

(12) United States Patent
Uerkvitz et al.

(10) Patent No.: US 11,268,727 B2
(45) Date of Patent: Mar. 8, 2022

(54) SELECTIVE ZONE AIR CONDITION SETPOINT MODE INTERFACE SYSTEMS AND METHODS

(71) Applicant: Johnson Controls Technology Company, Auburn Hills, MI (US)

(72) Inventors: John W. Uerkvitz, Valley Center, KS (US); Jonathan A. Burns, Wichita, KS (US); Theresa N. Gillette, Wichita, KS (US)

(73) Assignee: Johnson Controls Technology Company, Auburn Hills, MI (US)

( * ) Notice: Subject to any disclaimer, the term of this patent is extended or adjusted under 35 U.S.C. 154(b) by 0 days.

(21) Appl. No.: 16/369,986

(22) Filed: Mar. 29, 2019

(65) Prior Publication Data

US 2020/0309398 A1 Oct. 1, 2020

Related U.S. Application Data

(60) Provisional application No. 62/824,527, filed on Mar. 27, 2019.

(51) Int. Cl.

| | |
|---|---|
| ***F24F 11/50*** | (2018.01) |
| ***F24F 11/65*** | (2018.01) |
| ***F24F 11/74*** | (2018.01) |
| ***F24F 11/46*** | (2018.01) |
| *F24F 110/10* | (2018.01) |

(52) U.S. Cl.

CPC ..... *F24F 11/50* (2018.01); *F24F 11/46* (2018.01); *F24F 11/65* (2018.01); *F24F 11/74* (2018.01); *F24F 2110/10* (2018.01)

(58) Field of Classification Search

CPC .. F24F 11/50; F24F 11/74; F24F 11/46; F24F 11/65; F24F 2110/10; F24F 11/30; F24F 11/006; G05B 15/02

USPC ..... 700/276

See application file for complete search history.

(56) References Cited

U.S. PATENT DOCUMENTS

| | | | | |
|---|---|---|---|---|
| 6,912,429 | B1 * | 6/2005 | Bilger | H05B 47/105 700/19 |
| 9,115,908 | B2 | 8/2015 | Shetty et al. | |
| 9,500,379 | B2 | 11/2016 | Schnell et al. | |

(Continued)

FOREIGN PATENT DOCUMENTS

| | | |
|---|---|---|
| WO | 2016140842 | 9/2016 |

*Primary Examiner* — Rocio Del Mar Perez-Velez
*Assistant Examiner* — Alicia M. Choi
(74) *Attorney, Agent, or Firm* — Fletcher Yoder, P.C.

(57) ABSTRACT

A control system of a heat, ventilation, and air conditioning (HVAC) system. In some embodiments, the HVAC system includes an electronic display configured to concurrently display a plurality of zone icons that indicate a current setpoint mode corresponding to a plurality of building zones, wherein the current setpoint mode comprises a home setpoint mode and an away setpoint mode. Additionally, the HVAC system may include a control circuitry communicatively coupled to the electronic display. The control circuitry may be configured to toggle the current setpoint mode associated with the plurality of building zones between the home setpoint mode and the away setpoint mode based on a received user input. Further, the control circuitry may be configured to control operation of the HVAC system based on the current setpoint mode associated with each building zone of the plurality of building zones.

21 Claims, 12 Drawing Sheets

(56) References Cited

U.S. PATENT DOCUMENTS

| | | | | |
|---|---|---|---|---|
| 9,501,071 | B2 | 11/2016 | Shah | |
| 9,574,786 | B2 | 2/2017 | Daubman et al. | |
| 9,651,925 | B2 * | 5/2017 | Filbeck | G05B 15/02 |
| 9,772,115 | B2 | 9/2017 | Daubman et al. | |
| 9,983,612 | B2 | 5/2018 | Lamb | |
| 2002/0134849 | A1 * | 9/2002 | Disser | G05D 23/1902 236/47 |
| 2005/0270151 | A1 * | 12/2005 | Winick | H04L 12/2818 340/539.1 |
| 2007/0114293 | A1 | 5/2007 | Gugenheim | |
| 2009/0266904 | A1 * | 10/2009 | Cohen | F24F 11/30 236/51 |
| 2010/0070089 | A1 * | 3/2010 | Harrod | F24F 11/30 700/277 |
| 2010/0106308 | A1 * | 4/2010 | Filbeck | G05B 15/02 700/276 |
| 2012/0253521 | A1 * | 10/2012 | Storm | G05B 15/02 700/276 |
| 2013/0263034 | A1 * | 10/2013 | Bruck | G06F 3/04842 715/771 |
| 2014/0207291 | A1 | 7/2014 | Golden et al. | |
| 2014/0317029 | A1 | 10/2014 | Matsuoka et al. | |
| 2015/0033136 | A1 * | 1/2015 | Sasaki | G06F 3/0482 715/736 |
| 2016/0261425 | A1 * | 9/2016 | Horton | G05D 23/1917 |
| 2018/0023836 | A1 | 1/2018 | Quam et al. | |
| 2018/0129232 | A1 * | 5/2018 | Hriljac | F24F 11/56 |
| 2019/0089194 | A1 * | 3/2019 | Okita | H02J 13/00004 |
| 2019/0145642 | A1 * | 5/2019 | Heigl | F24F 11/30 454/239 |
| 2019/0285299 | A1 * | 9/2019 | Steinberg | F24F 11/62 |

* cited by examiner

SELECTIVE ZONE AIR CONDITION SETPOINT MODE INTERFACE SYSTEMS AND METHODS

CROSS REFERENCE TO RELATED APPLICATIONS

This application claims priority from and the benefit of U.S. Provisional Application Ser. No. 62/824,527, entitled "SELECTIVE ZONE AIR CONDITION SETPOINT MODE INTERFACE SYSTEMS AND METHODS," filed Mar. 27, 2019, which is herein incorporated by reference in its entirety for all purposes.

BACKGROUND

The present disclosure generally relates to heating, ventilation, and/or air conditioning (HVAC) systems and, more particularly, to configuring one or more air condition setpoints associated with a space serviced by an HVAC system.

This section is intended to introduce aspects of art that may be related to the techniques of the present disclosure, which are described and/or claimed below. This discussion is believed to be helpful in providing background information to facilitate a better understanding of the present disclosure. Accordingly, it should be understood that this section should be read in this light and not as an admission of prior art.

A climate control system, such as a heating, ventilation, and air conditioning (HVAC) system, is often deployed in a building to facilitate controlling air conditions, such as temperature and/or humidity, within the building. For example, an HVAC system may include equipment, such as an HVAC unit, which operates to produce temperature-controlled air, and/or an air damper, which operates to selectively restrict circulation of air, such as the temperature-controlled air and/or outside air, through internal spaces of the building. To facilitate controlling production and/or circulation of the temperature-controlled air, the HVAC system may include a control system that generally controls operation of its HVAC equipment.

Generally, a control system may control operation of climate control equipment and, thus, circulation of air through an internal space of a building based on a target air condition, such as a temperature setpoint, associated with the internal space. Thus, to facilitate improving occupant comfort and/or operational efficiency, the control system may enable user configuration of the target air condition, for example, to account for occupancy of the building. However, in some instances, user configuration of target air conditions may be a relatively complex process. In fact, at least in some instances, the relative complexity may discourage user customization of the target air conditions and, thus, efficacy of the climate control system, for example, at achieving a target occupant comfort level and/or a target power consumption.

BRIEF DESCRIPTION OF THE DRAWINGS

Various aspects of the present disclosure may be better understood upon reading the detailed description and upon reference to the drawings, in which.

SUMMARY

Figure 1:
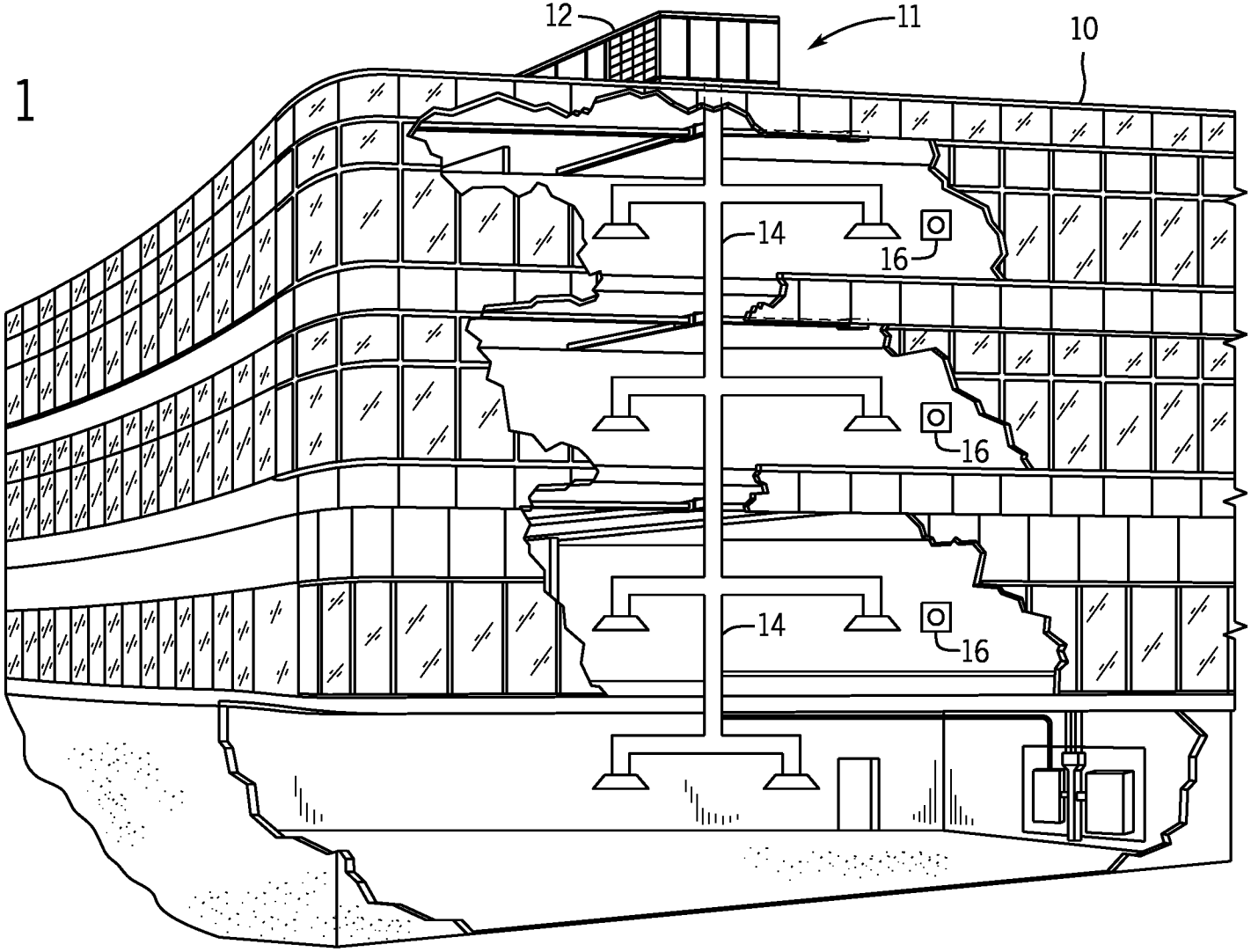
FIG. 1 is a partial cross-sectional view of a building that includes a heating, ventilation, and/or air conditioning (HVAC) system, in accordance with an embodiment of the present disclosure.

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, the present disclosure relates to a control system of a heat, ventilation, and air conditioning (HVAC) system. The control system includes a user interface configured to display current setpoint modes for a plurality of building zones service by the HVAC system. The control system also includes a control circuitry communicatively coupled to the user interface, wherein the control circuitry is configured to select between a home setpoint mode and an away setpoint mode for the plurality of building zones in response to a user input. The control circuitry is also configured to control operation of the HVAC system based on the plurality of current setpoint modes associated with the plurality of building zones.

In another embodiment, the present disclosure relates to a method of operating a heating, ventilation, and air conditioning (HVAC) system. The method includes determining, using control circuitry, a first current setpoint mode associated with a first building zone and a second current setpoint mode different from the first current setpoint mode associated with a second building zone. The method also includes determining, using the control circuitry, a first measured air temperature associated with the first building zone and a second measured air temperature associated with the second building zone. Further, the method includes controlling, using the control circuitry, air flow supplied to the first building zone based on the first current setpoint mode and the second building zone based on the second current setpoint mode, the second current setpoint mode, the first measured air temperature, and the second measured air temperature.

In another embodiment, the present disclosure relates to a heat, ventilation, and air conditioning (HVAC) system comprising a climate control system. The climate control system includes memory configured to store a first occupied temperature setpoint associated with a first building zone serviced by the HVAC system, a first unoccupied temperature setpoint associated with the first building zone, a second occupied temperature setpoint associated with a second building zone serviced by the HVAC system, and a second unoccupied temperature setpoint associated with the second building zone. The climate control system also includes an electronic display configured to concurrently display a whole system icon that indicates an operation mode of the climate control system as a whole, a first zone icon that indicates the operation mode of the first building zone, and a second zone icon that indicates the operation mode of the second building zone. Further, the climate control system includes control circuitry communicatively coupled to the memory and the electronic display. The control circuitry is configured to control operation of climate control equipment based part on the first unoccupied temperature setpoint associated with the first building zone and the second unoccupied temperature setpoint associated with the second building zone after a first user input that selects the whole system icon to transition the climate control system from an occupied operation mode to an unoccupied operation mode is confirmed. The control circuitry is also configured to control operation of the climate control equipment based on the first unoccupied temperature setpoint associated with the first building zone after a second user input that selects the first zone icon to transition the first building zone from the occupied operation mode to the unoccupied operation mode is confirmed.

DETAILED DESCRIPTION

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Generally, a heating, ventilation, and/or air conditioning (HVAC) system, may operate to facilitate controlling air conditions, such as temperature and/or humidity, present within a building. To facilitate controlling air conditions, an HVAC system may include equipment that operates to produce temperature-controlled air, which may be circulated through internal spaces of a building. For example, equipment deployed in the HVAC system may include an HVAC unit that, during operation or while running, actuates a compressor motor to circulate refrigerant that extracts heat from input air, thereby producing cooled air, which may then be supplied to a serviced space. Additionally or alternatively, the HVAC equipment may include a furnace that, during operation or while running, combusts fuel to inject heat into input air, thereby producing heated air, which may then be supplied to the serviced space.

To facilitate improving control over air conditions, in some instances, an HVAC system may include equipment that operates to enable selectively adjusting air circulation through serviced spaces in a building. For example, equipment deployed in the HVAC system may include an air damper disposed in ductwork fluidly coupled between the HVAC unit and the serviced space. As such, supply of temperature-controlled air produced by the HVAC unit to the serviced space may be limited at least in part by damper position of the air damper. For example, the air damper may block air flow between the HVAC unit and the serviced space when in a fully closed position and enable air flow between the HVAC unit and the serviced space when in an at least partially open position. Additionally, the air damper may gradually reduce resistance against air flow between the HVAC unit and the serviced space as its damper position transitions or moves from the fully closed position toward a fully open position.

To control operation of its equipment, an HVAC system often includes a control system. Generally, a control system may control operation of HVAC equipment based at least in part on one or more target air conditions, such as a target temperature indicated via a temperature setpoint associated with a space conditioned or otherwise serviced by the HVAC equipment. For example, when temperature measured within a serviced space and a temperature setpoint associated with the serviced space differ by less than or equal to a difference threshold, a control system deployed in the HVAC system may instruct the HVAC system to turn off or maintain off the HVAC unit. On the other hand, when the temperature measured within the serviced space and the temperature setpoint differ by more than the difference threshold, the control system may instruct the HVAC system to turn on or run the HVAC unit, thereby producing temperature-controlled air, which may be supplied to the serviced space.

To facilitate improving control granularity over air conditions, in some instances, the serviced space within one or more buildings may be divided into multiple building zones, which may each be associated with one or more independently controllable target air conditions. For example, a first building zone may be associated with a first temperature setpoint while a second building zone may be associated with a second temperature setpoint, which may be relatively independently set (e.g., configured or programmed) or controlled relative to the first temperature setpoint. To facilitate achieving independently controllable target air conditions, in some instances, climate control equipment, such as a set of one or more air dampers, may be associated with each building zone.

For example, a first air damper associated with the first building zone may be disposed in ductwork fluidly coupled between the HVAC unit and the first building zone. Similarly, a second air damper associated with the second building zone may be disposed in ductwork fluidly coupled between the HVAC unit and the second building zone, and so on. As such, a control system may control supply of the temperature-controlled air produced by the HVAC unit to the first building zone at least in part by controlling damper position of the first air damper and the supply of the temperature-controlled air produced by the HVAC unit to the second building zone at least in part by controlling damper position of the second air damper.

As described above, at least in some instances, multiple building zones may be included in a space serviced by an HVAC system. To facilitate further improving control over air conditions, in some instances, a serviced space may be selectively associated with different air condition setpoints. For example, a serviced space may be associated with a home temperature setpoint when a home mode is selected and an away temperature setpoint when an away mode is selected. In other words, at least in some instances, the value of an air condition setpoint currently associated with a serviced space may depend at least in part on a setpoint (e.g., away or home) mode selected for the serviced space.

In fact, at least in some instances, each building zone in a serviced space may be selectively associated with air condition setpoints corresponding with different setpoint modes. For example, a first building zone may be selectively associated with either a first home temperature setpoint or a first away temperature setpoint. Additionally, a second building zone may be selectively associated with either a second home temperature setpoint or a second away temperature setpoint.

In other words, at least in some instances, a user, such as a homeowner or a service technician, may set air condition setpoints associated with different setpoint modes based at least in part on target air conditions for corresponding occupancy states. For example, the user may set the first home temperature setpoint based on a target temperature of the first building zone when the first building zone is occupied and/or the first away temperature setpoint based on a target temperature of the first building zone when the first building zone is unoccupied. Additionally or alternatively, the user may set the second home temperature setpoint based on a target temperature of the second building zone when the second building zone is occupied and/or the second away temperature setpoint based on a target temperature of the second building zone when the second building zone is unoccupied.

Furthermore, in some instances, a control system of an HVAC system may be implemented to enable user configuration (e.g., programming or setting) of a setpoint mode and, thus, air condition setpoints to be used to control air conditions in a space serviced by the HVAC system. For example, when a home (e.g., first setpoint) mode is selected for the serviced space, the control system may control operation of HVAC equipment based at least in part on the first home temperature setpoint associated with the first building zone and the second home temperature setpoint associated with the second building zone. On the other hand, when an away (e.g., second setpoint) mode is selected for the serviced space, the control system may control operation of HVAC equipment based at least in part on the first away temperature setpoint associated with the first building zone and the second away temperature setpoint associated with the second building zone.

However, at least in some instances, occupancy state of different building zones in a serviced space may differ. For example, the first building zone may be occupied while the second building zone is unoccupied. As such, when the serviced space as a whole is in the home mode, the HVAC system may control temperature in the second building zone based on the second home temperature setpoint even through the second building zone is unoccupied, which, at least in some instances, may affect power consumption and, thus, operational efficiency of the HVAC system, for example, due to the second home temperature setpoint being set further from an environmental temperature and, thus, resulting in increased power consumption compared to the second away temperature setpoint. On the other hand, when the serviced space as a whole is in the away mode, the HVAC system may control temperature in the first building zone based on the first away temperature setpoint even through the first building zone is occupied, which, at least in some instances, may affect (e.g., reduce) occupant comfort level, for example, due to the first away temperature setpoint being set further from the environmental temperature compared to the first home temperature setpoint. In other words, at least in some instances, only enabling a user to configure a setpoint mode of a space serviced by a climate control system as a whole may affect (e.g., reduce) efficacy of the climate control system, for example, at achieving a target occupant comfort level and/or a target power consumption.

Accordingly, to facilitate improving efficacy of climate control systems, the present disclosure provides techniques for implementing and/or operating a climate control system to enable selectively adjusting setpoint mode of one or more building zones in a serviced space and/or selectively adjusting setpoint mode of the serviced space as a whole, for example, during an initial configuration setup process and/or a subsequent configuration adjustment process. In particular, in some embodiments, the climate control system may be implemented to enable selecting different setpoint modes for different building zones serviced by the climate control system. For example, the climate control system may enable a home (e.g., first setpoint) mode to be selected for a first building zone while an away (e.g., second setpoint) mode is selected for a second building zone.

In other words, as will be described in more detail below, the techniques described in the present disclosure may facilitate improving user customization of a climate control system. At least in some instances, improving user customization may facilitate improving efficacy of a climate control system, for example, by enabling a user, such as a homeowner or a service technician, to selectively configure air condition setpoint modes for individual building zones.

To facilitate user interaction, a control system may include one or more electronic displays and one or more input devices, such as a hard button and/or a touch sensor. For example, the electronic display may display a zone overview graphical user interface (GUI), which provides visual representations of one or more parameters, such as a setpoint mode and a temperature setpoint, associated with a corresponding building zone. In some embodiments, the zone overview GUI may include an icon and/or a soft button that enables user initiation of a setpoint mode configuration process. For example, the control system may initiate the setpoint mode configuration process in response to a user input selecting an icon that includes a visual representation of the current setpoint mode of the building zone.

To facilitate setpoint mode configuration, in some embodiments, the electronic display may display a system configuration GUI, for example, in response to a user input received during display of a zone overview graphical user interface corresponding with a current building zone. In some embodiments, the system configuration GUI may include one or more icons and/or soft buttons that each provides a visual representation of a current setpoint mode of a corresponding building zone. For example, an icon corresponding with a building zone may be a first (e.g., shaded) color when the setpoint mode of the building zone is the home mode and a second (e.g., unshaded) color when the setpoint mode of the building zone is the away mode.

In fact, in some embodiments, the system configuration GUI may provide a visual representation of a current setpoint mode of multiple building zones serviced by an HVAC system. In other words, in such embodiments, the system configuration GUI may provide a visual representation of a current setpoint mode of a building zone corresponding with a zone overview graphical user interface from which the setpoint mode configuration process was initiated as well as current setpoint modes of one or more other building zones. For example, the system configuration GUI may include a first icon that provides a visual representation of a current setpoint mode of the first building zone and a second icon that provides a visual representation of a current setpoint mode of the second building zone.

Moreover, in some embodiments, a system configuration GUI may enable a user, such as a homeowner or service technician, to adjust the setpoint mode of one or more building zones. In particular, in some embodiments, the control system may toggle the setpoint mode of a building zone between different setpoint modes in response to a user input selecting a corresponding setpoint mode icon on the system configuration GUI. For example, when in the home mode, the control system may change the first building zone to the away mode in response to a user input selecting the first icon. Additionally or alternatively, when in the away mode, the control system may change the second building zone to the home mode in response to a user input selecting the second icon. It should be noted that the control system may also toggle the setpoint mode of a building zone between different setpoint modes in response to user input received via a device associated with a user, such as a computer, mobile device, smart phone, tablet, and the like. Additionally or alternatively, the control system may also toggle the setpoint mode of a building zone between different setpoint modes in response to user input received via a device that supports a voice user interface, such as a voice command device.

To facilitate indicating a current setpoint mode of each building zone, in some embodiments, the electronic display may adaptively adjust display of the system configuration GUI. In particular, in some embodiments, the system configuration GUI may be adaptively adjusted in response to a change to the setpoint mode of a building zone. For example, when the first building zone is changed from the home mode to the away mode, the electronic display may adjust display of the system configuration GUI such that the first icon is changed from the first (e.g., shaded) color to and the second (e.g., unshaded) color, thereby indicating that the first building zone is currently in the away mode. Additionally or alternatively, when the second building zone is changed from the away mode to the home mode, the electronic display may adjust display of the system configuration GUI such that the second icon is changed from the second color to and the first color, thereby indicating that the second building zone is currently in the away mode.

Furthermore, in some embodiments, a system configuration GUI may enable a user to indicate completion of a setpoint mode configuration process. For example, the system configuration GUI may include a done icon (e.g., soft button) and/or a cancel icon (e.g., soft button). In some embodiments, in response to user selection of the cancel icon, the control system may disregard a setpoint mode change made via the system configuration GUI and revert each building zone to its setpoint mode before initiation of the setpoint mode configuration process. On the other hand, in response to user selection of the done icon, the control system may finalize the setpoint mode change made via the system configuration GUI, for example, by updating one or more setpoint mode indicators stored in memory of the HVAC system. In this manner, as will be described in more detail below, the techniques described in the present disclosure may facilitate reducing complexity of setpoint mode configuration from for climate control systems, which, at least in some instances, may encourage user customization and, thus, improve likelihood of a user adjusting improperly configured air condition setpoint modes, for example, to facilitate achieve a target occupant comfort level and/or a target power consumption.

To help illustrate, a building 10 serviced by a climate control system—namely a heating, ventilating, and air conditioning (HVAC) system 11—is shown in FIG. 1. In some embodiments, the building 10 may be a commercial structure or a residential structure. Additionally, the HVAC system 11 may include equipment, such as one or more HVAC units 12 and/or one or more furnaces, that operates to produce temperature-controlled air, which may be supplied to internal spaces within the building via ductwork 14.

As described above, to facilitate controlling operation of the HVAC equipment, the HVAC system 11 may include a control system. In some embodiments, the control system may be implemented using one or more control devices 16, such as a thermostat control device, a zone control device (e.g., panel or module), and/or an equipment control device (e.g., controller). For example, a thermostat control device 16 may be used to designate target air conditions, such as a target temperature and/or a target humidity level, within the building 10 and/or measure air conditions present within the building 10.

To facilitate achieving target air conditions, the control system may control operation of the HVAC unit 12 and/or other HVAC equipment, such as one or more fans and/or one or more or air dampers disposed in the ductwork 14, based at least in part on the measured air conditions relative to the target air conditions. For example, when difference between a measured temperature and a target temperature is greater than a threshold, the control system may turn on or run the HVAC unit 12 to circulate refrigerant through one or more heat exchangers, which facilitates producing temperature-controlled air. Additionally, the control system may turn on a fan and/or adjust damper position of an air damper to facilitate supplying the temperature-controlled air to internal spaces within the building 10 via the ductwork 14.

To facilitate producing temperature-controlled air, in some embodiments, the HVAC unit 12 may be selectively operated in different operating modes, such as a first-stage cooling mode, a second-stage cooling mode, a fan only mode, a first-stage heating mode, and/or a second-stage heating mode. For example, when operating in a heating (e.g., heat pump) mode, the HVAC unit 12 may inject heat into input air, thereby producing heated air, which may then be supplied to internal spaces within the building 10. Additionally or alternatively, the HVAC system 11 may include a furnace that operates to produce the heated air. Furthermore, when operating in a cooling (e.g., air conditioning) mode, the HVAC unit 12 may extract heat from input air, thereby producing cooled air, which may then be supplied to internal spaces within the building 10.

In some embodiments, the HVAC system 11 may be a split HVAC system, for example, which includes an outdoor HVAC unit and an indoor HVAC unit. Additionally or alternatively, an HVAC unit 12 may be a single package unit that includes other equipment, such as a blower, a fan, an integrated air handler, and/or an auxiliary heating unit. For example, in the depicted embodiment, the HVAC unit 12 is a rooftop unit (RTU) that operates to condition a supply air stream, for example, which includes environmental air and/or a return air from the building 10.

Figure 2:
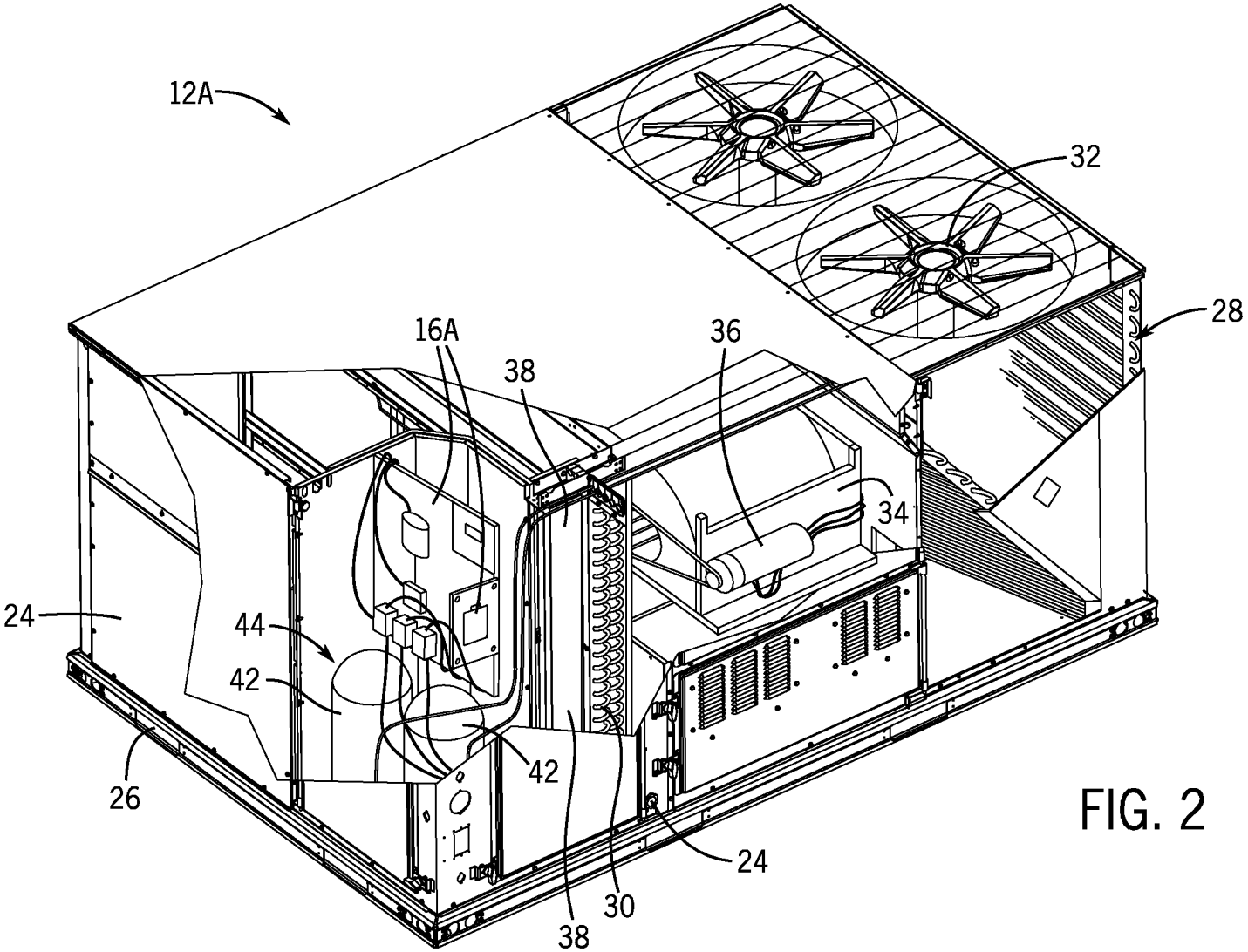
FIG. 2 is a partial cross-sectional view of an example of HVAC equipment that may be included in the HVAC system of FIG. 1, in accordance with an embodiment of the present disclosure.

To help illustrate, an example of a single package HVAC unit 12A is shown in FIG. 2. As depicted, the HVAC unit 12A includes a housing 24, a first heat exchanger 28, a second heat exchanger 30, one or more fans 32, a blower assembly 34, one or more air filters 38, a compressor 44, and an equipment control device 16A (e.g., controller). As described above, in some embodiments, a control system may include multiple control devices 16, such as one or more equipment control devices 16A. In other words, in such embodiments, the equipment control device 16A may communicate with one or more other control devices 16 implemented in the control system. For example, the equipment control device 16A may transmit (e.g., output) operational parameters, such as operational status, of the HVAC unit 12A to another control device 16. Additionally or alternatively, the equipment control device 16A may receive a data (e.g., control or command) signal transmitted from the other control device 16, which instructs the equipment control device 16 to adjust operation of the HVAC unit 12A.

As in the depicted example, the equipment control device 16A and/or other components of the HVAC unit 12A may be enclosed with the housing 24, for example, to protect to internal components from environmental contaminants and/or other contaminants. In some embodiments, the housing 24 may be constructed of galvanized steel and insulated with aluminum foil faced insulation. However, it should be appreciated that the depicted example is merely intended to be illustrative and not limiting. For example, in other embodiments, the equipment control device 16A may be implemented external to the housing 24 and/or separate from the HVAC unit 12A.

In any case, as in the depicted example, rails 26 may be joined to the bottom perimeter of the housing 24 to provide a foundation for the HVAC unit 12A. For example, the rails 26 may provide access for a forklift and/or overhead rigging to install and/or remove the HVAC unit 12A. Additionally, in some embodiments, the rails 26 may fit into "curbs," for example, implemented on the roof of the building 10, to enable the HVAC unit 12 to provide air to the ductwork 14 while blocking contaminants, such as rain, from leaking into the building 10.

As will be described in more detail below, the first heat exchanger 28 and the second heat exchanger 30 may be included in a refrigerant circuit (e.g., loop) that operates to circulate refrigerant, such as R-410A. In particular, the first heat exchanger 28 and the second heat exchanger 30 may each include tubing through which the refrigerant is circulated to facilitate heat exchange between the refrigerant and surrounding air. In some embodiments, the tubing may include multichannel tubing, copper tubing, aluminum tubing, and/or the like.

In other words, the first heat exchanger 28 and the second heat exchanger 30 may implement a thermal cycle in which the refrigerant undergoes phase changes and/or temperature changes as it flows through the first heat exchanger 28 and the second heat exchanger 30, thereby heating surrounding air and/or cooling surrounding air. For example, when operating in a cooling mode, the first heat exchanger 28 may function as a condenser to extract heat from the refrigerant and the second heat exchanger 30 may function as an evaporator to use the refrigerant to extract heat from the air to be supplied to internal spaces within the building 10. On the other hand, when operating in a heating mode, the first heat exchanger 28 may function as an evaporator to inject heat into the refrigerant and the second heat exchanger 30 may function as a condenser to inject heat from the refrigerant into the air to be supplied to internal spaces within the building 10.

To facilitate heat exchange, during operation, the fans 32 may draw environmental or outside air through the first heat exchanger 28. In this manner, the environmental air may be used to heat and/or cool as the refrigerant as it flows through the tubing of the first heat exchanger 28. Additionally, a blower assembly 34, powered by a motor 36, may draw air to be supplied to internal portions of the building 10 through the second heat exchanger 30. In some embodiments, the supply air may include environmental air, outside air, return air, inside air, or any combination thereof. In any case, in this manner, the refrigerant may be used to heat and/or cool the supply air as it flows through the tubing of the second heat exchanger 30.

In some embodiments, the HVAC unit 12A may flow supply air through one or more air filters 38, which operate to remove particulates and/or other air contaminants from the supply air. For example, one or more air filters 38 may be disposed on an air intake side of the second heat exchanger 30 to reduce likelihood of contaminants contacting tubing of the second heat exchanger 30. Additionally or alternatively, one or more air filters 38 may be disposed on an air output side of the HVAC unit 12A to reduce likelihood of contaminants being supplied to internal spaces within the building 10.

The HVAC unit 12 also may include other HVAC equipment, such as a compressor 44, a solid-core filter drier, a disconnect switch, an economizer, pressure switches, and/or the like. In some embodiments, the compressor 44 may be a scroll compressor, a rotary compressor, a screw compressor, or a reciprocating compressor. Additionally, in some embodiments, the compressor 44 may be implemented using multiple selectable compressor stages 42. For example, the compressor 44 may be implemented in a dual stage configuration with two compressor stages 42.

In this manner, an HVAC system 11 may be implemented with one or more single package HVAC units 12A. As described above, in other embodiments, an HVAC system 11 may be a split HVAC system. In such embodiments, instead of a single package HVAC unit 12A, the HVAC system 11 may be implemented with split HVAC units, such as an outdoor HVAC unit and an indoor HVAC unit.

Figure 3:
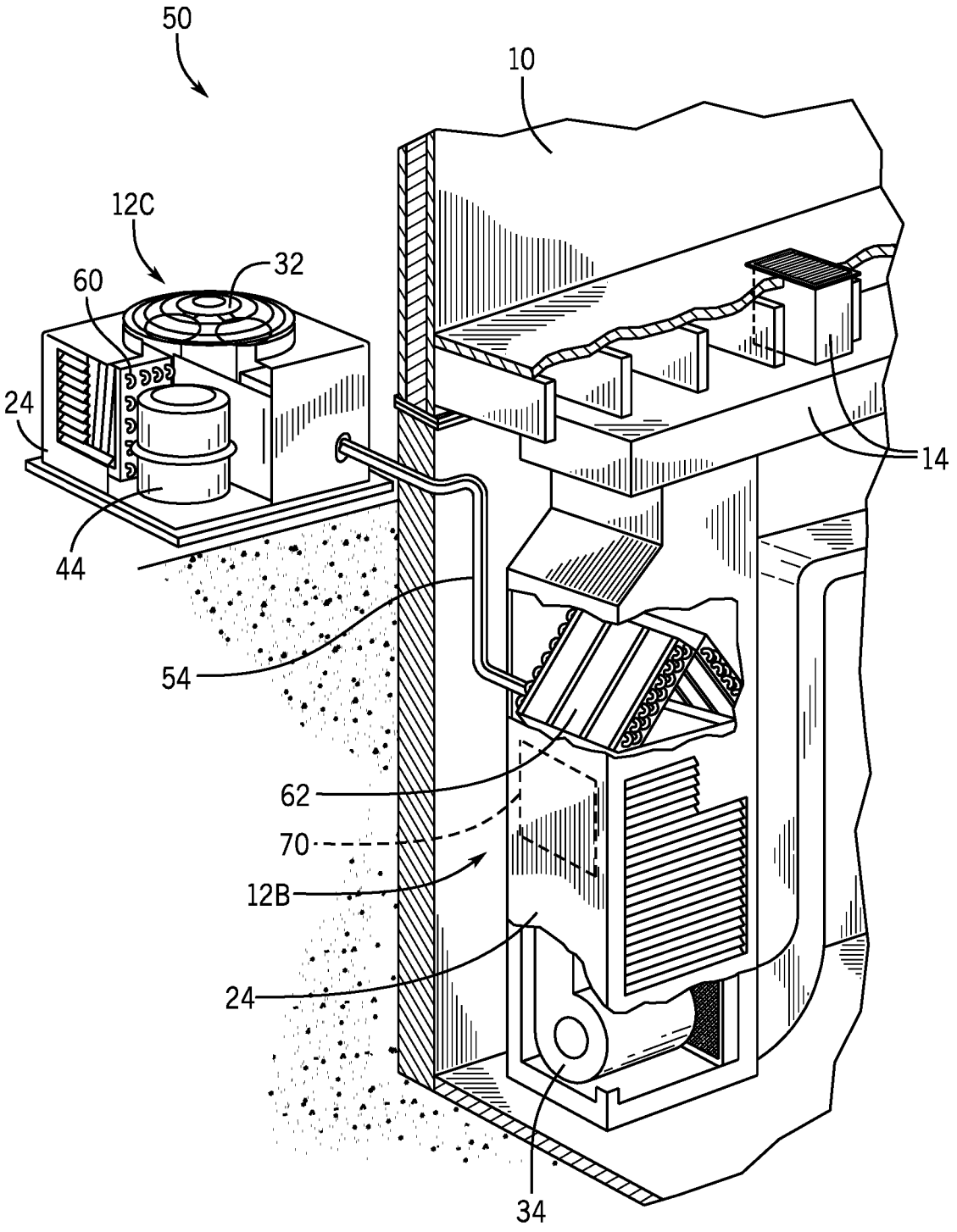
FIG. 3 is a partial cross-sectional view of another example of HVAC equipment that may be included in the HVAC system of FIG. 1, in accordance with an embodiment of the present disclosure.

To help illustrate, an example of a portion 50 of an HVAC system 11, which includes an indoor HVAC unit 12B and an outdoor HVAC unit 12C, is shown in FIG. 3. As depicted, the outdoor HVAC unit 12C may be implemented outside of the building 10, for example, adjacent a side of the building 10 and covered by a shroud to protect the system components from debris and/or other contaminants. On the other hand, the indoor HVAC unit 12B may be implemented inside the building 10, for example, in a utility room, an attic, a basement, or the like.

Additionally, as depicted, the outdoor HVAC unit 12C includes an outdoor heat exchanger 60 and a fan 32. In some embodiments, the outdoor heat exchanger 60 may be operated in a similar manner as the first heat exchanger 28 in the single package HVAC unit 12A. For example, the outdoor heat exchanger 60 may function as a condenser when in a cooling mode and as an evaporator when in a heating mode.

Furthermore, as depicted, the indoor HVAC unit 12B includes an indoor heat exchanger 62 and a blower assembly 66. In some embodiments, the indoor HVAC unit 12B may also include a furnace 70, for example, when HVAC system 11 is not implemented to operate in a heat pump mode. In such embodiments, the furnace 70 may combust fuel, such as natural gas, to produce a combustion product, which may be flowed through tubbing of a separate indoor heat exchanger to facilitate injecting heat from the combustion product into supply air to be routed through ductwork 14 of the building 10.

Additionally or alternatively, in some embodiments, the indoor heat exchanger 62 may be operated in a similar manner as the second heat exchanger 30 in the single package HVAC unit 12A. For example, the indoor heat exchanger 62 may function as an evaporator when in a cooling mode and as a condenser when in a heating mode. Thus, as in the depicted example, the indoor HVAC unit 12B and the outdoor HVAC unit 12C may be fluidly coupled via one or more refrigerant conduits 54 to form a refrigerant circuit (e.g., loop), for example, typically transferring primarily liquid refrigerant in one direction and primarily vaporized refrigerant in the opposite direction.

Figure 4:
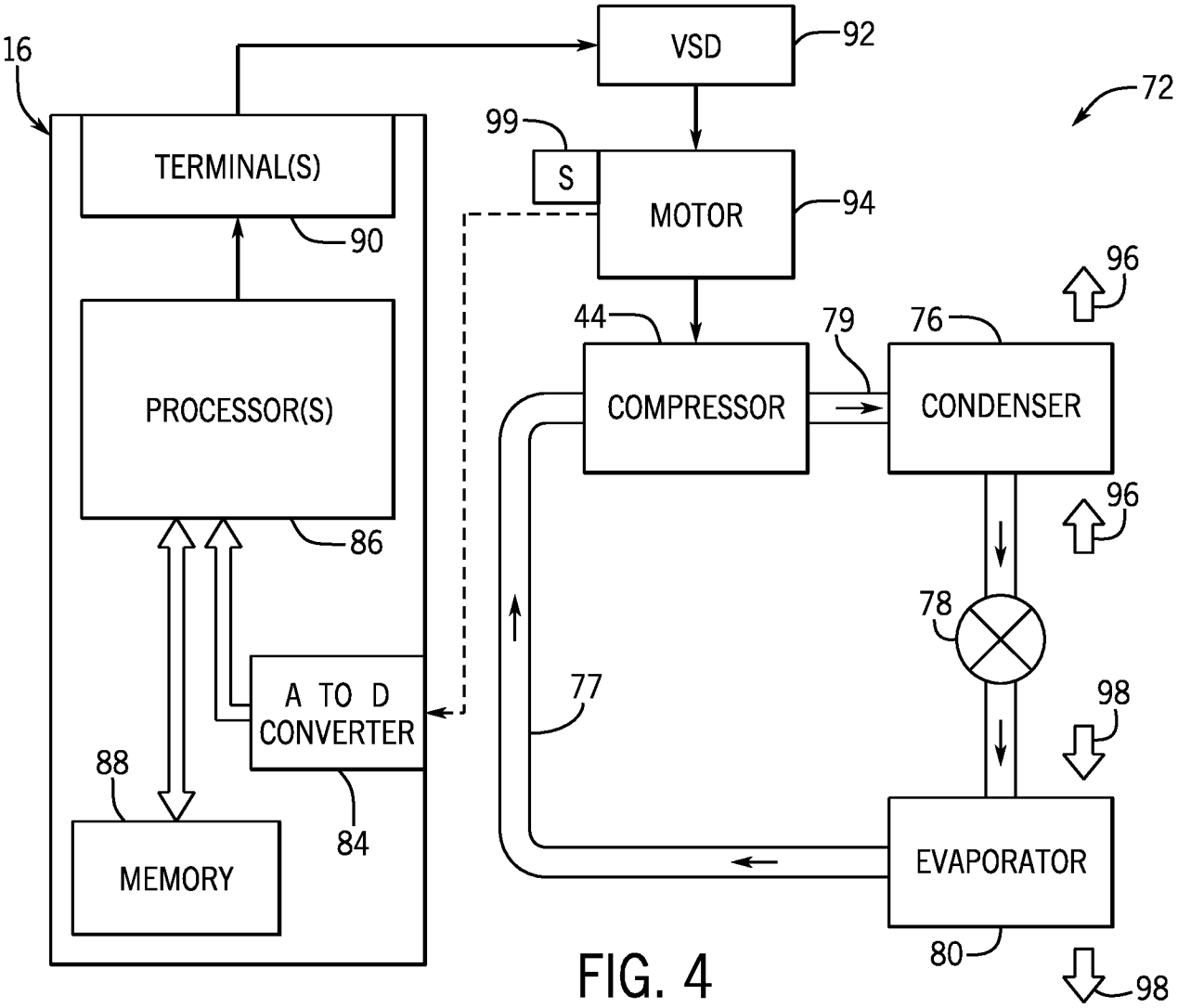
FIG. 4 is a block diagram of a refrigerant loop that may be implemented in the HVAC system of FIG. 1, in accordance with an embodiment of the present disclosure.

To help illustrate, an example of a refrigerant circuit 72 is shown in FIG. 4. As depicted, the refrigerant circuit 72 includes a compressor 44, a condenser 76, one or more expansion devices 78 or valves, and an evaporator 80. As described above, in some embodiments, the condenser 76 and/or the evaporator 80 may each be implemented using one or more heat exchangers. In any case, actuation of the compressor 44 generally drives circulation of refrigerant through the refrigerant circuit 72. In particular, the compressor 44 may receive refrigerant vapor from the evaporator 80 via a suction line 77, compress the refrigerant vapor, and output the compressed refrigerant vapor to the condenser 76 via a discharge line 79.

As the refrigerant flows through the condenser 76, a first air flow 96 may be used to extract heat from refrigerant to facilitate condensing the vapor into liquid. When operating in a cooling mode, the first air flow 96 may be produced using environmental or outside air, for example, by actuating a fan 32. On the other hand, when operating in a heating mode, the first air flow 96 may be produced using supply air, for example, by actuating a blower assembly 34. Before being supplied to the evaporator 80, the refrigerant may flow through one or more expansion devices 78 to facilitate reducing pressure.

As the refrigerant flows through the evaporator 80, the refrigerant may undergo a phase change from liquid to vapor that facilitates extracting heat from a second air flow 98. When operating in a cooling mode, the second air flow 98 may be produced using supply air, for example, by actuating a blower assembly 34. On the other hand, when operating in a heating mode, the second air flow 98 may be produced using environmental or outside air, for example, by actuating a fan 32. Thereafter, the refrigerant may be circulated back to the compressor 44.

As depicted, the compressor 44 may be actuated by a compressor motor 94 during operation. In some embodiments, the compressor motor 94 may be a switched reluctance motor, an induction motor, an electronically commutated permanent magnet motor, and/or another suitable electromechanical motor. In other words, the compressor motor 94 may actuate the compressor 44 when electrical power is supplied to the compressor motor 94.

To facilitate controlling supply of electrical power to the compressor motor 94, a variable speed drive (VSD) 92 may be coupled to the compressor motor 94. In particular, the variable speed drive 92 may receive alternating current (AC) electrical power having a fixed line voltage and a fixed line frequency from a power source, such as an electrical grid. Additionally, a control device 16 may control operation of the variable speed drive 92 to supply alternating current (AC) electrical power with a variable voltage and/or a variable frequency to the compressor motor 94, for example, by controlling switching devices implemented in the variable speed drive 92. In other embodiments, the compressor motor 94 may be powered directly from an AC power source or a direct current (DC) power source, such as a battery.

To facilitate controlling operation of the variable speed drive 92, as in the depicted example, the control device 16 may include an analog to digital (A/D) converter 84, one or more processors 86, memory 88, and one or more terminals 90, which may be used to couple the control device 16 to the variable speed drive 92, one or more sensors 99, and/or another control device 16. For example, to control switching in the variable speed drive 92, a processor 86 implemented in the control device 16 may execute instructions stored in a tangible, non-transistor, computer readable medium, such as the memory 88, to determine control and/or command signals, which may be communicated to the variable speed drive 92 via a terminal 90. Additionally, in some embodiments, the control device 16 may control switching in the variable speed drive 92 based at least in part on feedback from the compressor motor 94 and/or other sensors 99, for example, which may be received as analog electrical signals via a terminal 90 and converted to digital data via the analog to digital (A/D) converter 84 before processing and/or analysis by one or more processors 86.

Figure 5:
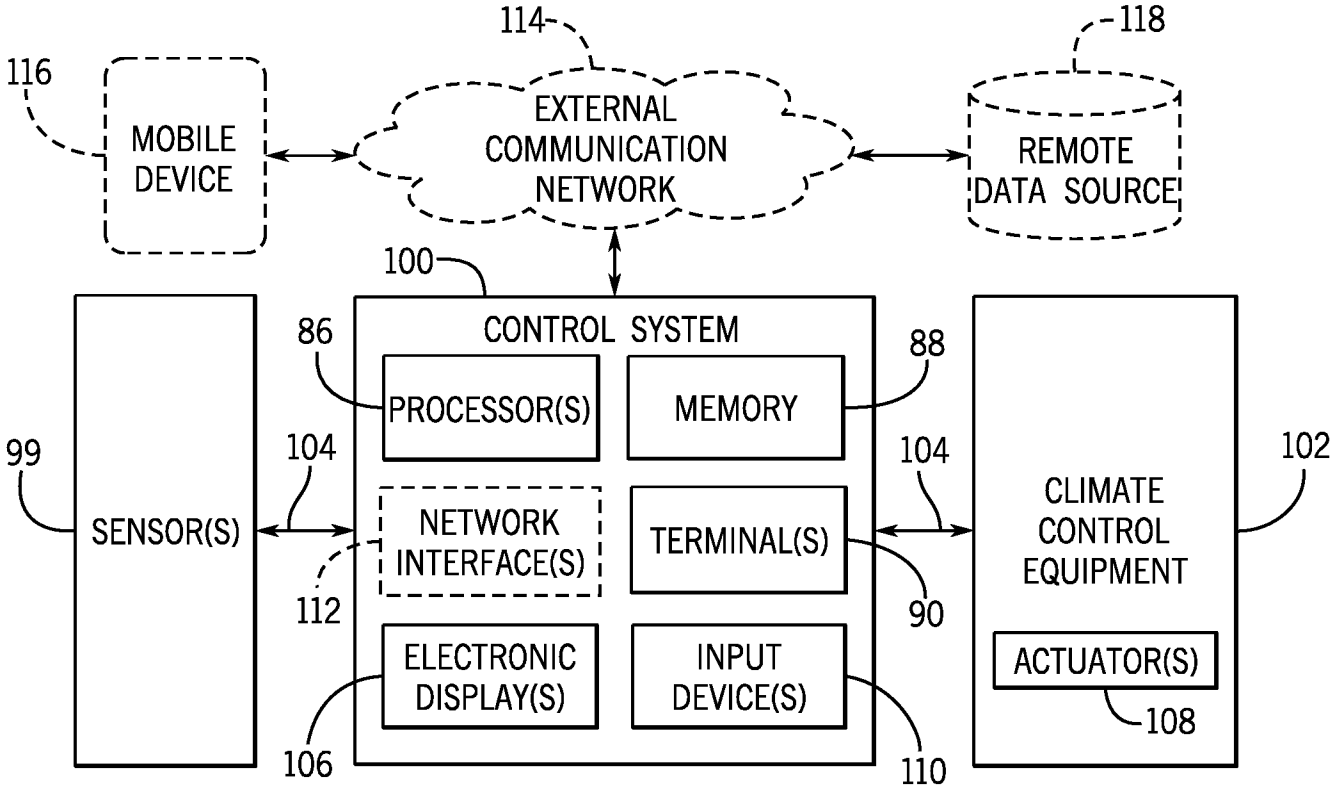
FIG. 5 is a block diagram of a portion of the HVAC of FIG. 1 that includes a control system, one or more sensors, and HVAC equipment, in accordance with an embodiment of the present disclosure.

In any case, as described above, a climate control system, such as an HVAC system 11, may include a control system that controls operation of climate control equipment deployed therein to facilitate controlling air conditions, such as temperature and/or humidity level, present within a building 10 serviced by the HVAC system 11. To help illustrate, an example of a control system 100, which may be deployed in a climate control system, such as an HVAC system 11, is shown in FIG. 5. As will be described in more detail below, in some embodiments, the control system 100 may be implemented using one or more control devices 16, such as thermostat control devices, zone control devices, and/or equipment control devices 16A.

In any case, as in the depicted example, the control system 100 may include one or more processors 86 and memory 88, for example, deployed in one or more control devices 16 of the control system 100. Generally, during operation of the control system 100, the one or more processors 86 may execute instructions stored in the memory 88, for example, to determine a control action to be implemented by one or more actuators 108, such as a compressor motor 94, in the climate control equipment 102 based at least in part on measured air conditions relative to target air conditions. Thus, in some embodiments, the one or more processors 86 may include processing circuitry, for example, implemented in one or more general purpose microprocessors, one or more application specific processors (ASICs), one or more field programmable logic arrays (FPGAs), or any combination thereof.

In addition to executable instructions, in some embodiments, the memory 88 may store data to be processed and/or analyzed by the one or more processors 86. For example, the memory 88 may store an air condition setpoint associated with a serviced space, an air condition setpoint schedule associated with the serviced space, and/or a setpoint mode indicator that indicates a setpoint mode for the serviced space. Thus, in some embodiments, the memory 88 may include one or more tangible, non-transitory, computer-readable media. For example, the memory 88 may include one or more random access memory (RAM) devices, one or more read only memory (ROM) devices, one or more flash memory devices, one or more hard disk drives, one or more optical discs, or any combination thereof.

Additionally, as in the depicted example, the control system 100 may include one or more terminals 90, for example, implemented on one or more control devices 16 of the control system 100. In some embodiments, the terminals 90 may be used to couple the control system 100 to one or more sensors 99 and/or to climate control equipment 102, for example, by connecting a first wire between a first terminal 90 of the control system 100 and a sensor 99 and/or connecting a second wire between a second terminal 90 of the control system 100 and climate control equipment 102 to form one or more internal communication networks 104. Additionally or alternatively, control devices 16 implemented in the control system 100 may communicate with one another via one or more internal communication networks 104, for example, formed at least in part by connecting a wire between a terminal 90 of a first control device 16, such as a thermostat control device 16, and a terminal of a second control device 16, such as a zone control device 16 or an equipment control device 16A.

To facilitate user interaction, as in the depicted example, the control system 100 may include one or more electronic displays 106 and one or more input devices 110. In particular, as will be described in more detail below, the control system 100 may instruct an electronic display 106 to display one or more graphical user interfaces (GUIs) that provide visual representations of information related to the climate control system. For example, the electronic display 106 may display a graphical user interface (GUI) that provides a visual representation of a temperature setpoint mode to be used to control air temperature in a serviced space. Thus, in some embodiments, an electronic display 106 may include a liquid crystal display (LCD), an organic light-emitting diode (OLED) electronic display, and/or the like.

Additionally, the control system 100 may receive instructions from a user, such as a homeowner or a service technician, via user inputs detected by its one or more inputs devices 110. For example, while the visual representation of the temperature setpoint mode is being displayed, an input device 110 may receive a user input that requests a change in the value of a temperature setpoint included in the temperature setpoint mode. Thus, in some embodiments, an input device 110 may include a hard button, a switch, a touch sensor disposed on or integrated with an electronic display 106, and/or the like.

Moreover, in some embodiments, the control system 100 may include one or more network interfaces 112, which may be used to communicatively couple the control system 100 to an external communication network 114. For example, a network interface 112 may connect the control system 100 to a personal area network (PAN), such as a Bluetooth network, a local area network (LAN), such as an 802.11x Wi-Fi network, and/or a wide area network (WAN), such as a cellular network. In other words, in some embodiments, a network interface 112 may enable the control system 100 to communicate with a mobile device 116 and/or a remote data source 118, such as a weather database and/or a utility provider server, connected to the external communication network 114.

However, it should be appreciated that the depicted example is merely intended to be illustrative and not limiting. In particular, in some embodiments, one or more of the depicted components may be optional and, thus, not included in the control system 100. For example, in other embodiments, a control system 100 may be designed to only communicate via internal communication networks 104 and, thus, not include a network interface 112. Additionally or alternatively, the control system 100 may include one or more components other than the depicted components. For example, in some embodiments, the control system 100 may additionally include one or more analog-to-digital converters 84. In any case, as described above, in some embodiments, a control system 100 may be implemented using multiple control devices 16.

Figure 6:
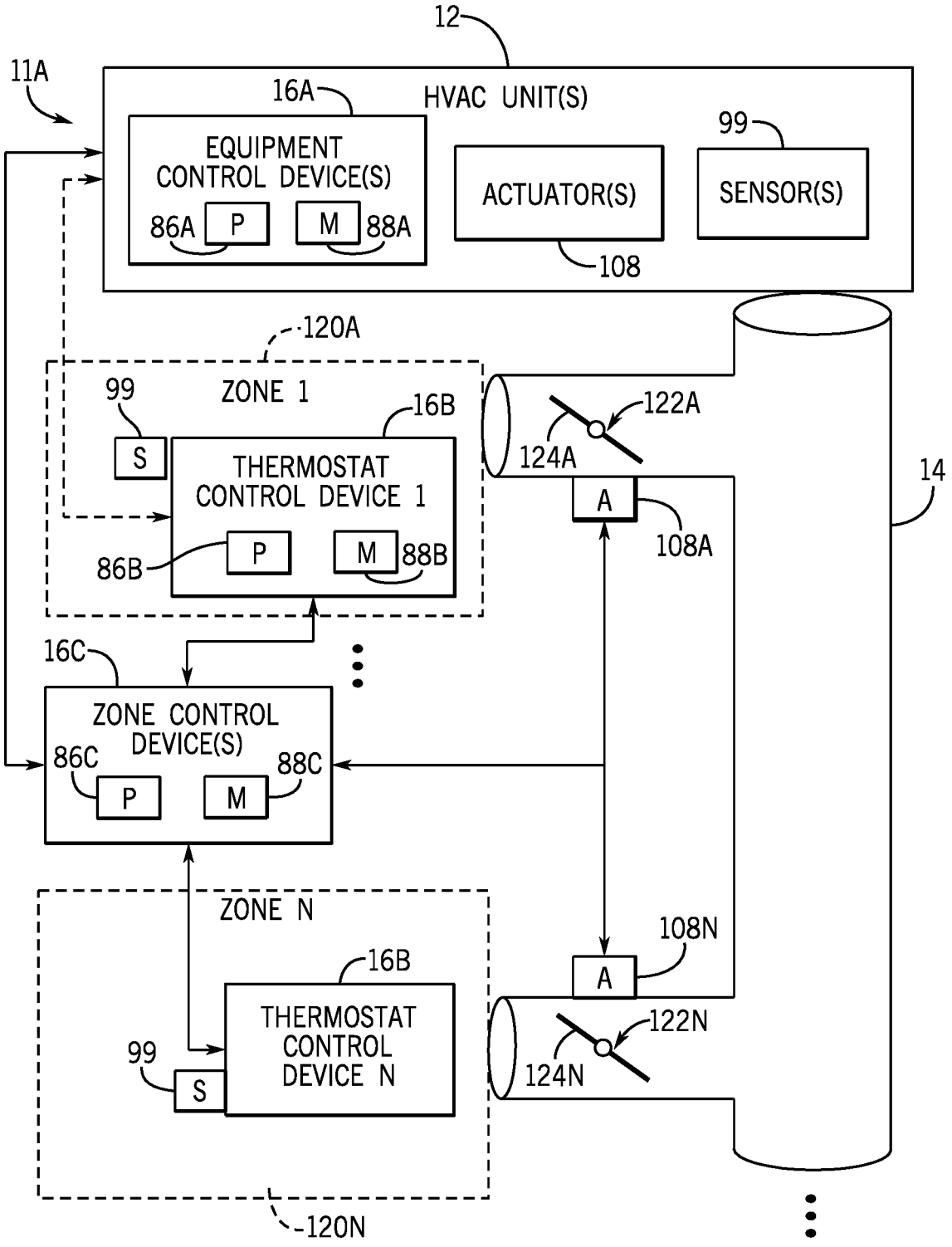
FIG. 6 is a block diagram of an example of the control system of FIG. 5 implemented as a zone control system deployed across multiple building zones, in accordance with an embodiment of the present disclosure.

To help illustrate, an example of a zoned HVAC system 11A, which includes a control system 100 implemented using multiple control devices 16, is shown in FIG. 6. As described above, to facilitate improving air condition control granularity, a space serviced by an HVAC system 11 may be divided into multiple building zones 120, which may each be associated with one or more independently controllable target air conditions. For example, the serviced space may be divided into a first building zone 120A and an Nth building zone 120N.

To facilitate controlling air conditions within building zones 120, in some embodiments, the control system 100 may include one or more thermostat control devices 16B, for example, each corresponding with and/or deployed in a different building zone 120. In other words, as in the depicted example, the control system 100 may include a first thermostat control device 16B corresponding with the first building zone 120A and an Nth thermostat control device 16B corresponding with the Nth building zone 120N. In some embodiments, a thermostat control device 16B may determine one or more air conditions measured by one or more sensors 99 in a corresponding building zone 120. Based at least in part on the measured air conditions, the thermostat control device 16B may output a call signal that requests conditioning (e.g., cooling, heating, and/or ventilation) of the corresponding building zone 120, for example, when a measured air temperature deviates from a temperature setpoint by more than a difference threshold.

In addition to thermostat control devices 16B, as described above, a control system 100 may include one or more equipment control devices 16A (e.g., controllers) implemented to control operation of climate control equipment 102, such as an HVAC unit 12. Thus, as in the depicted example, an equipment control device 16A may be deployed in an HVAC unit 12 along with one or more actuators 108, such as a compressor motor 94, and/or one or more sensors 99, such as a leaving air temperature sensor 99. In some embodiments, climate control equipment 102 deployed in the zoned HVAC system 11A may additionally include one or more damper assemblies 122 each with a damper actuator 108, such as a damper motor, and one or more damper blades 124, such as a damper plate.

To facilitate achieving independently controllable target air conditions, as in the depicted example, a set of one or more damper assemblies 122 may be fluidly coupled between the HVAC unit 12 and each of the multiple building zones 120. For example, a first set including a first damper assembly 122A may be disposed in ductwork 14 fluidly coupled between the HVAC unit 12 and the first building zone 120A. Additionally, an Nth set including an Nth damper assembly 122N may be disposed in ductwork 14 fluidly coupled between the HVAC unit 12 and the Nth building zone 120N. As such, air flow from the HVAC unit 12 to the first building zone 120A may be controlled at least in part by controlling damper position of a first damper blade 124A in the first damper assembly 122A while air flow from the HVAC unit 12 to the Nth building zone 120N may be controlled at least in part by controlling damper position of an Nth damper blade 124N in the Nth damper assembly 122N.

To facilitate controlling damper position, as described above, a control system 100 may include one or more zone control devices 16C, such as a zone control panel (e.g., board) or a zone control module. To control damper position of a damper assembly 122, in some embodiments, a zone control device 16C may be coupled to its damper actuator 108, for example, to enable the zone control device 16C to output a close signal that causes the damper actuator 108 to transition a damper blade 124 coupled thereto to a more closed position and/or an open signal that causes the damper actuator 108 to transition the damper blade 124 to a more open position. In other words, as in the depicted example, the zone control device 16C may be communicatively coupled to a first damper actuator 108A of the first damper assembly 122A to enable the zone control device 16C to control damper position of the first damper assembly 122A and, thus, air flow from the HVAC unit 12 to the first building zone 120A. Similarly, the zone control device 16C may be coupled to an Nth damper actuator 108N of the Nth damper assembly 122A to enable the zone control device 16C to control damper position of the Nth damper assembly 122N and, thus, air flow from the HVAC unit 12 to the Nth building zone 120N.

However, it should be appreciated that the depicted example is merely intended to be illustrative and not limiting. In particular, in other embodiments, a control system 100 may include more than four control devices 16 or fewer than four control devices 16. Moreover, in some embodiments, a control system 100 may include multiple instances of the same type of control device 16. For example, in some embodiments, a zone control device 16C, such as a zone control panel or a zone control module, may be implemented with a finite number of terminals 90 and, thus, may be wired to a finite number of thermostat control devices 16B and/or a finite number of damper assemblies 122, thereby limiting the number of building zones 120. To facilitate increasing the number of building zones 120, in such embodiments, a control system 100 may include multiple zone control devices 16C, for example, with a primary zone control device 16C controlling air flow from the HVAC unit 12 to the first building zone 120A and to the Nth building zone 120N while a secondary (e.g., adder) zone control device 16C controls air flow from the HVAC unit 12 to an N+1th building zone 120 and to a 2Nth building zone 120. Furthermore, in some embodiments, the zoned HVAC system 11A may include multiple HVAC units 12, for example, including one or more single package (e.g., rooftop) HVAC units 12A, one or more indoor HVAC units 12B, and/or one or more outdoor HVAC units 12C.

In any case, as described above, in some embodiments, a control device 16 deployed in the control system 100 may include one or more processors 86 and memory 88. For example, the equipment control device 16A may include a first one or more processors 86A and first memory 88A. Additionally, a thermostat control device 16B may include a second one or more processors 86B and second memory 88B. Furthermore, the zone control device 16C may include a third one or more processors 86C and third memory 88C.

Moreover, as described above, in some embodiments, memory 88 may store instructions executable by the one or more processors 86. For example, the second one or more processors 86B implemented in a thermostat control device 16B may execute instructions stored in the second memory 88B to determine air conditions measured by one or more sensors 99 and/or to output a call signal that requests conditioning (e.g., heating, cooling, and/or ventilation) of a corresponding building zone 120 when the measured value deviates from a corresponding air condition setpoint by more than a difference threshold. Additionally, the third one or more processors 86C implemented in the z one control device 16C may execute instructions stored in the third memory 88C, for example, to convert between different communication protocols and/or to control operational parameters, such as damper position, of one or more damper assemblies 122 based at least in part on conditioning call signals received from one or more thermostat control devices 16B deployed in the zoned HVAC system 11A. Furthermore, the first one or more processors 86A implemented in the equipment control device 16A may execute instructions stored in the first memory 88A, for example, to control operational parameters, such as actuation speed, of one or more actuators 108 in the HVAC unit 12 and/or to determine operational parameters, such as leaving air temperature, measured by one or more sensors 99 in the HVAC unit 12.

In addition to executable instructions, as described above, memory 88 may store data to be processed, analyzed, and/or otherwise used by a control system 100. In fact, in some embodiments, memory addresses in the memory 88 may be allocated or otherwise dedicated to storing parameter data associated with specific building zones 120. For example, a first one or more memory addresses may be allocated for indicating parameters associated with the first building zone 120A, such a setpoint mode of the first building zone 120A and/or one or more air condition setpoints associated with the first building zone 120A. Similarly, an Nth one or more memory addresses may be allocated for indicating parameters associated with the Nth building zone 120N, such a setpoint mode of the Nth building zone 120N and/or one or more air condition setpoints associated with the Nth building zone 120N.

In other words, in some embodiments, parameters associated with a building zone 120 may include a setpoint mode indicator that identifies a setpoint mode of the building zone 120. As an illustrative example, the setpoint mode indicator may be "1-bit" when a home (e.g., occupied or first setpoint) mode is selected for a building zone 120 and a "0-bit" when the away (e.g., unoccupied or second setpoint) mode is selected for the building zone 120. In this manner, a zoned HVAC system 11A may operate to control air conditions within one or more building zones 120 based at least in part on associated parameters.

Figure 7:
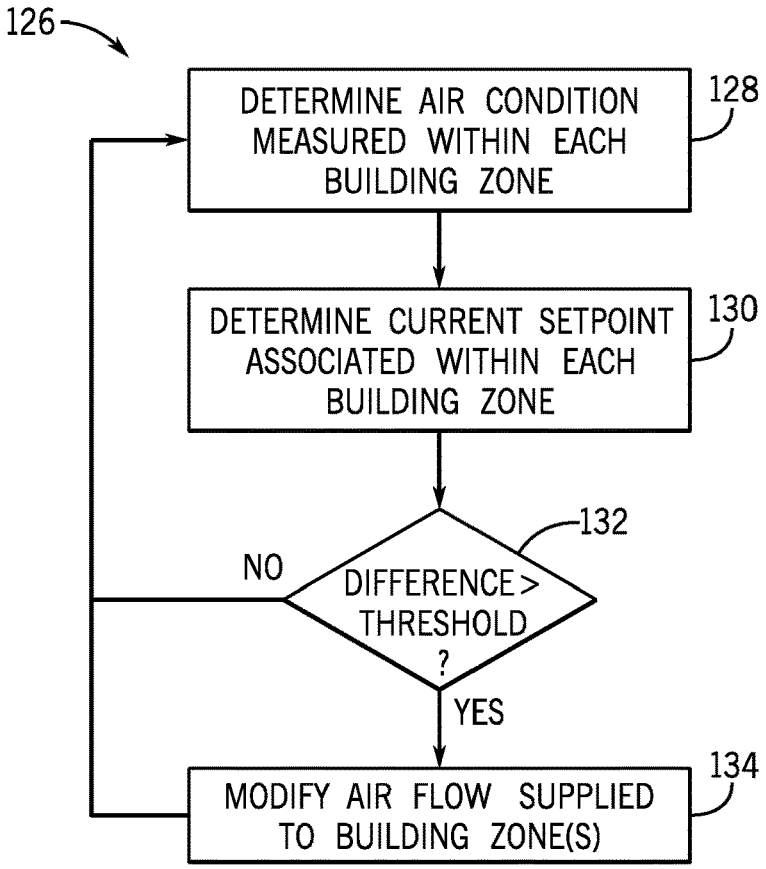
FIG. 7 is a flow diagram of an example process for operating the zone control system of FIG. 6, in accordance with an embodiment of the present disclosure.

To help illustrate, an example of a process 126 for operating a zoned HVAC system 11A is described in FIG. 7. Generally, the process 126 includes determining an air condition measured within each building zone (process block 128), determining a current air condition setpoint associated within each building zone (process block 130), determining whether difference between one or more of the measured air condition is greater than corresponding current air condition setpoints (decision block 132), and modifying air flow supplied to one or more of the building zones when the difference is greater than a different threshold (process block 134).

Although described in a particular order, which represents a particular embodiment, it should be noted that the process 126 may be performed in any suitable order. Additionally, embodiments of the process 126 may omit process blocks and/or include additional process blocks. Moreover, in some embodiments, the process 126 may be implemented at least in part by executing instructions stored in a tangible, non-transitory, computer-readable medium, such as memory 88 implemented in a control system 100, using processing circuitry, such as a processor 86 implemented in the control system 100.

Accordingly, in some embodiments, a control system 100 deployed in a zoned HVAC system 11A may determine a value of an air conditions measured within one or more building zones 120 (process block 128). As described above, in some embodiments, one or more sensors 99 may be deployed in a building zone 120 to measure a value of air conditions present in the building zone 120. Additionally, in some embodiments, the control system 10 may store one or more measured air condition values in memory 88, for example, deployed in a corresponding thermostat control device 16B and/or a zone control device 16C communicatively coupled to the thermostat control device 16B.

Furthermore, the control system 100 may also determine a current air condition setpoint associated with each building zone 120 serviced by the zone HVAC system 11A (process block 130). As described above, in some embodiments, a building zone 120 may be selectively associated with one of multiple air condition setpoints. Additionally, as described above, at least in some instances, the value of an air condition setpoint associated with different setpoint modes may differ, for example, to enable air conditions in a corresponding building zone 120 to be adjusted based on occupancy state of the building zone 120. In other words, in some embodiments, the control system 100 may determine a current air condition setpoint associated with a building zone 120 based at least in part on the setpoint mode of the building zone 120.

Figure 8:
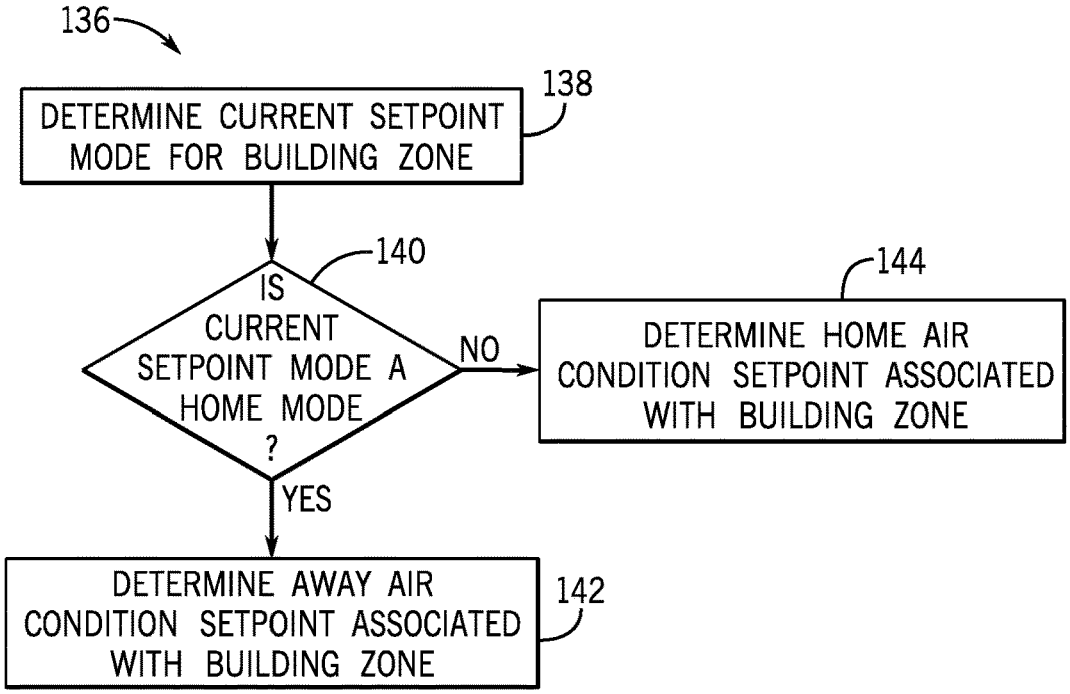
FIG. 8 is a flow diagram of an example process for determining a current setpoint associated with a building zone, in accordance with an embodiment of the present disclosure.

To help illustrate, an example of a process 136 for determining a current air condition setpoint associated with a building zone 120 is described in FIG. 8. Generally, the process 136 includes determining a current setpoint mode for a building zone (process block 138) and determining whether the current setpoint mode is a home setpoint mode (decision block 140). Additionally, the process 136 includes determining an away air condition setpoint associated with the building zone when the current setpoint mode is not in home setpoint mode (process block 144) and determining a home air condition setpoint associated with the building zone when the current setpoint mode is the home setpoint mode (process block 144).

Although described in a particular order, which represents a particular embodiment, it should be noted that the configuration process 136 may be performed in any suitable order. Additionally, embodiments of the configuration process 136 may omit process blocks and/or include additional process blocks. Moreover, in some embodiments, the configuration process 136 may be implemented at least in part by executing instructions stored in a tangible, non-transitory, computer-readable medium, such as memory 88 implemented in a control system 100, using processing circuitry, such as a processor 86 implemented in the control system 100.

Accordingly, in some embodiments, a control system 100 may determine a current setpoint mode of a building zone 120 (process block 138) and determine whether the current setpoint mode is a home mode (decision block 140). As described herein, in some embodiments, a control system 100 may determine the current setpoint mode based on values stored in a setpoint mode indicator that identifies a setpoint mode of the building zone 120. As described above, the setpoint mode indicator may be "1-bit" when a home (e.g., occupied or first setpoint) mode is selected for a building zone 120 and a "0-bit" when the away (e.g., unoccupied or second setpoint) mode is selected for the building zone 120. Parameters of the building zones including the setpoint mode indicator may be stored in tangible, non-transitory, computer-readable medium, such as memory. Thus, process block 138 may involve retrieving parameters from a memory address designated for a building zone. Additionally, the process block 140 may involve determining the current setpoint point mode based on the parameters, such as determining home mode when the setpoint mode indicator is a "0-bit."

When the current setpoint mode is not the home mode, the control system 100 may determine an away air condition setpoint associated with the building zone 120 (process block 144). As described above, memory may store parameters of building zones including the setpoint mode indicator. For example, the memory 88 may store an air condition setpoint associated with a building zone 120, an air condition setpoint schedule associated with the building zone 120. As an illustrative example, memory may store a "0-bit" associated with an away mode, as well as an air condition setpoint associated with the away setpoint mode. Thus, block 144 may involve retrieving an air condition setpoint associated with the building zone 120 based on the away setpoint mode.

On the other hand, when the current setpoint mode is the home mode, the control system 100 may determine a home air condition setpoint associated with the building zone 120 (process block 142). For example, memory may store a "1-bit" associated with a home mode, as well as an air condition setpoint associated with the away setpoint mode. Thus, block 142 may involve retrieving an air condition setpoint associated with the building zone 120 based on the home setpoint mode. In some embodiments, the air condition setpoint may be a temperature setpoint. In this manner, a control system 100 may operate to determine a current air condition setpoint associated with a building zone 120. In a similar manner, the control system 100 may determine a current air condition setpoint associated with one or more other building zones 120.

Returning to the process 126 of FIG. 7, the control system 100 may then determine whether a difference between a measured air condition and a corresponding air condition setpoint is greater than a difference threshold (decision block 132). Additionally, when the difference is greater than the difference threshold, the control system 100 may adjust air flow supplied to a corresponding building zone 120 (process block 134). For example, when the difference is greater than the difference threshold, the control system 100 may instruct an HVAC unit 12 to turn on, thereby producing conditioned air that may be supplied to the building zone 120 to facilitate reducing deviation from the air condition setpoint. Additionally or alternatively, to facilitate reducing deviation from the air condition setpoint, the control system 100 may instruct a corresponding damper assembly 122 to transition to a more open position, thereby enabling an increase in conditioned air supplied to the building zone 120. In this manner, a control system 100 may control operation of HVAC equipment to control air flow and, thus, air conditions present within serviced building zones 120, for example, after completion of an initial setup configuration process.

In fact, in some embodiments, an HVAC system 11 may enable user configuration of one or more parameters associated a building zone 120 via a configuration process, for example, performed after the initial setup configuration process. For example, the configuration process may enable a user such as a homeowner or a service technician, to configure (e.g., set or program) one or more air condition setpoints associated with the building zone 120. Additionally or alternatively, the configuration process may enable the user to configure (e.g., select or program) a setpoint mode associated with one or more building zones 120 serviced by the HVAC system 11.

Figure 9:
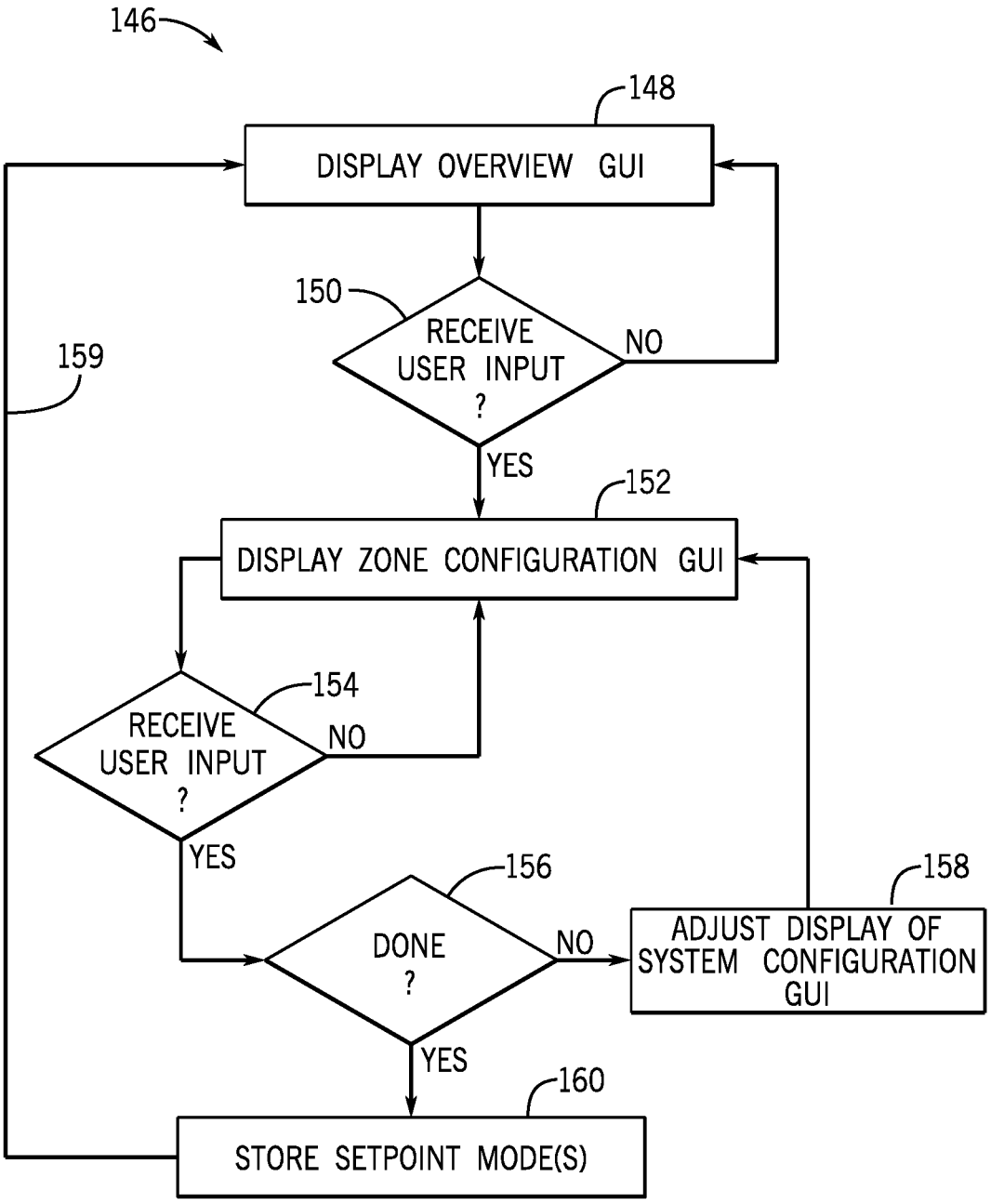
FIG. 9 is a flow diagram of an example process for updating a setpoint mode of one or more building zone, in accordance with an embodiment of the present disclosure.

To help illustrate, an example of a setpoint mode configuration process 146 is described in FIG. 9. Generally, the setpoint mode configuration process 146 includes displaying a zone overview GUI (process block 148), determining whether a user input has been received (decision block 150), and displaying a system configuration GUI after a user input has been received during display of the zone overview GUI (process block 152). Additionally, the setpoint mode configuration process 146 includes, during display of the system configuration GUI, determining whether a user input has been received (decision block 154), determining whether the user input is a done user input after the user input has been received (decision block 156), adjusting display of the system configuration GUI when the user input is not a done user input (process block 158), and storing one or more setpoint modes with corresponding building zones when the user input is a done user input (process block 160).

Although described in a particular order, which represents a particular embodiment, it should be noted that the setpoint mode configuration process 146 may be performed in any suitable order. Additionally, embodiments of the setpoint mode configuration process 146 may omit process blocks and/or include additional process blocks. Moreover, in some embodiments, the setpoint mode configuration process 146 may be implemented at least in part by executing instructions stored in a tangible, non-transitory, computer-readable medium, such as memory 88 implemented in a control system 100, using processing circuitry, such as a processor 86 implemented in the control system 100.

Accordingly, in some embodiments, a control system 100 in a zoned HVAC system 11A may instruct an electronic display 106 to display a zone overview GUI (process block 148). In some embodiments, a zone overview GUI 106 may be displayed on a thermostat control device 16B to provide an overview of a corresponding building zone 120. For example, a first thermostat control device 16B may display a first zone overview GUI 106 that provides an overview of a first building zone 120A. Additionally or alternatively, an Nth thermostat control device 16N may display an Nth zone overview GUI 106 that provides an overview of an Nth building zone 120N. To facilitate providing an overview of a corresponding building zone 120, in some embodiments, a zone overview GUI 106 may include a visual representation of one or more parameters associated with the building zone 120.

Figure 10:
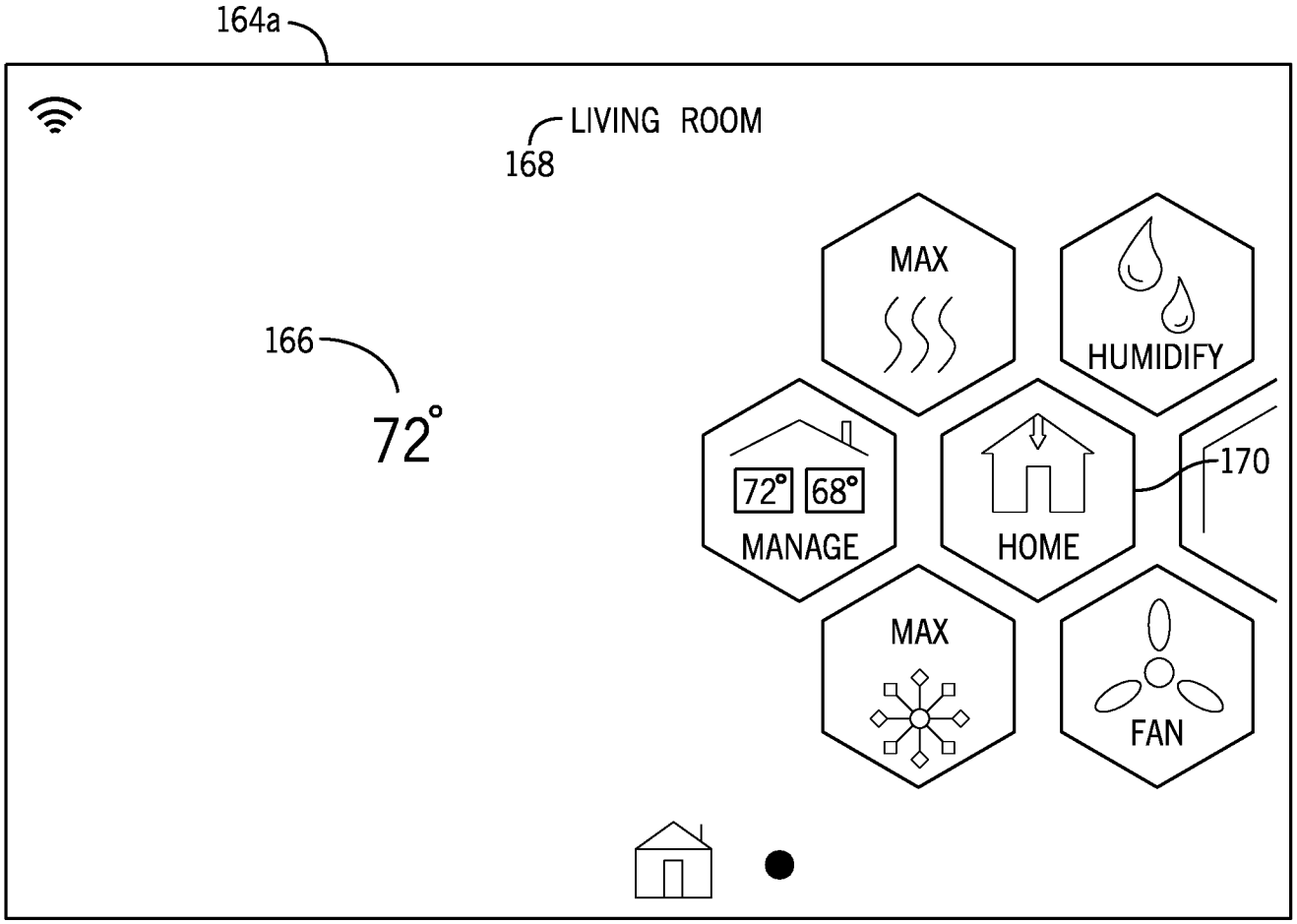
FIG. 10 is an example of a zone overview graphical user interface (GUI) including a visual representation a current setpoint mode of a corresponding building zone, in accordance with an embodiment of the present disclosure.

To help illustrate, an example of a zone overview GUI 164A, which may be displayed on an electronic display 106, is shown in FIG. 10. In general, a zone overview GUI 164 may provide a visual representation of one or more banners and/or icons (e.g., soft buttons) that present visual representations of information associated with a corresponding building zone 120. For example, the zone overview GUI 164A may include a temperature banner 166 that provides a visual representation of a temperature setpoint associated with the building zone 120 and/or temperature measured in the building zone 120. Additionally, as in the depicted example, the zone overview GUI 164A may include an identity banner 168 that provides a visual representation of an identity, such as a name or location, of the building zone 230.

Furthermore, as in the depicted example, the zone overview GUI 164A may include a current setpoint mode icon 170 that provides a visual representation of a current setpoint mode of the building zone 120. In particular, in the depicted example, the current setpoint mode icon 170 indicates that the current setpoint mode is the home mode. On the other hand, when the building zone 120 is in the away mode, a different current setpoint mode icon 170 may be displayed to indicate that the current setpoint mode of the building zone 120 is the away mode. In this manner, a zone overview GUI 164 associated with a building zone 120 may be displayed on an electronic display 106 to provide a visual overview of the building zone 120.

Returning to the setpoint mode configuration process 146 of FIG. 9, during display of the zone overview GUI 164, the control system 100 may determine whether a user input has been received (process block 150). In some embodiments, a zone overview GUI 164 may include one or more user selectable icons. Additionally, in some embodiments, the control system 100 may initiate a configuration process that enables user configuration of one or more parameters of the zone HVAC system 11A in response to selection of an icon. For example, the control system 100 may initiate a setpoint mode configuration process in response to a user input selecting the current setpoint mode icon 170 on the zone overview GUI 164.

To facilitate user setpoint mode configuration, the control system 100 may instruct the electronic display 106 to display a system configuration GUI in response to a user input selecting the current setpoint mode icon 170 on the zone overview GUI 164 (process block 152). In some embodiments, a system configuration GUI may provide a visual representation of a current setpoint mode of a building zone 120 corresponding with the zone overview GUI 164 from which the setpoint mode configuration process was initiated. In some embodiments, the system configuration GUI may also provide a visual representation of a current setpoint mode of one or more other building zones 120 serviced by the zone HVAC system 11A.

Figure 11:
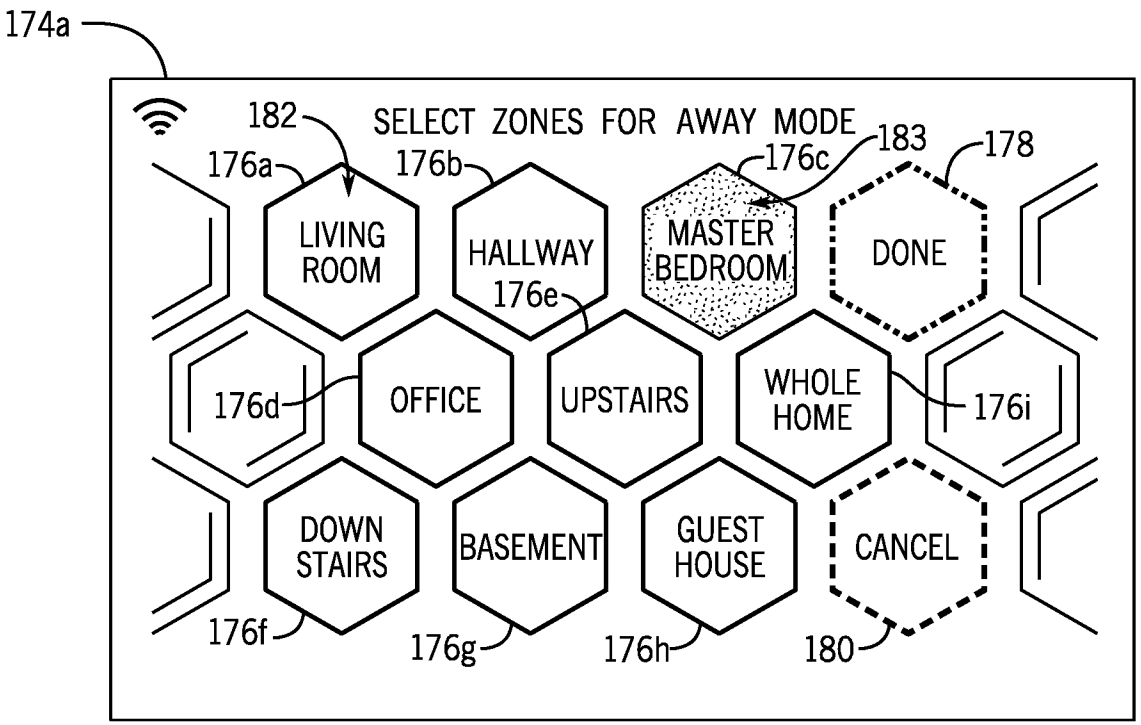
FIG. 11 is an example of a zone setpoint selection graphical user interface (GUI) including a visual representation of a setpoint mode configuration of multiple building zones, in accordance with an embodiment of the present disclosure.

To help illustrate, an example of a system configuration GUI 174 is shown in FIG. 11. As in the depicted example, a system configuration GUI 174 may include multiple setpoint mode icons (e.g., soft buttons) 176 that each visually indicates a current setpoint mode of a corresponding building 120 or a corresponding group of multiple building zones 120. For example, the system configuration GUI 174 may include a first setpoint mode icon 176A that provides a visual representation of a current setpoint mode of a living room building zone 120.

Additionally, as in the depicted example, the system configuration GUI 174 may include a second setpoint mode icon 176B that provides a visual representation of a current setpoint mode of a hallway building zone 120, a third setpoint mode icon 176C that provides a visual representation of a current setpoint mode of a master bedroom building zone 120, and a fourth setpoint mode icon 176D that provides a visual representation of a current setpoint mode of an office building zone 120. Furthermore, as in the depicted example, the system configuration GUI 174 may include a fifth setpoint mode icon 176E that provides a visual representation of a current setpoint mode of an upstairs building zone 120, a sixth setpoint mode icon 176F that provides a visual representation of a current setpoint mode of a downstairs building zone 120, a seventh setpoint mode icon 176G that provides a visual representation of a current setpoint mode of a basement building zone 120, and an eighth setpoint mode icon 176H that provides a visual representation of a current setpoint mode of a guest house building zone 120. Moreover, as in the depicted example, the system configuration GUI 174 may include a ninth setpoint mode icon 176I that provides a visual representation of a current setpoint mode of a whole house (e.g., serviced space as a whole), which includes multiple building zones 120.

To facilitate indicating a current setpoint mode, in some embodiments, the system configuration GUI 174 vary presentation of a corresponding setpoint mode icon 176. For example, a shaded setpoint mode icon 182 may indicate that a corresponding one or more building zones 120 is in the home mode. On the other hand, an un-shared setpoint mode icon 183 may indicate that a corresponding one or more building zones 120 is in the away mode. In this manner, a system configuration GUI 174 may be displayed on an electronic display 106 to provide visual representations of a current setpoint modes of multiple building zones 120 serviced by a zone HVAC system 11A.

Returning to the setpoint mode configuration process 146 of FIG. 9, during display of the system configuration GUI 174, the control system 100 may determine whether a user input has been received (decision block 154). In some embodiments, a system configuration GUI 174 may include one or more user selectable icons. For example, the control system 100 may toggle a current setpoint mode of one or more corresponding building zones 120 in response to a user input selecting a corresponding setpoint mode icon 176. As an illustrative example, the current setpoint mode of the living room building zone 120 may be change from the home mode to the away mode in response to a user input selecting the first setpoint mode icon 176 A. Additionally or alternatively, the current setpoint mode of the master bedroom building zone 176 may be changed from the away mode to the home mode in response to a user input selecting the third setpoint mode icon 176C.

Moreover, as in the example system configuration GUI 174 depicted in FIG. 11, the user selectable icons may additionally include a done icon (e.g., soft button) 178 and/or a cancel icon (e.g., soft button) 180. In some embodiments, a user, such as a homeowner or service technician, may select the cancel icon 180 when the user has completed setpoint mode configuration, but does not wish to implement (e.g., finalize) the setpoint mode configuration. On the other hand, the user may select the done icon 178 when the user has completed setpoint mode configuration and wishes to implement the setpoint mode configuration.

In other words, returning to the setpoint mode configuration process 146 of FIG. 9, the control system 100 may determine whether a user input received during display of the system configuration GUI 174 indicates that setpoint mode configuration has been completed (decision block 156). For example, the control system 100 may determine that setpoint mode configuration has been completed when the user input selects the done icon 178 or the cancel icon 180 on the system configuration GUI 174. As described above, in some embodiments, a user may select the done icon 178 when the wishes to implement (e.g., finalize) the setpoint mode configuration.

As such, when the user input detected during display of the system configuration GUI 174 selects the done icon 178, the control system 100 may associate each setpoint mode currently indicated by the setpoint mode icons 176 of the system configuration GUI 174 with a corresponding building zones 120 (process block 160). In other words, in response to selection of the done button 178, the control system 100 may update setpoint modes changed via the system configuration GUI 174, for example, by adjusting corresponding setpoint mode indicators stored in memory 88.

Additionally, as described above, in some embodiments, a user may select the cancel icon 180 when the user does not wish to implement (e.g., finalize) the setpoint mode configuration. Thus, when the user input detected during display of the system configuration GUI 174 selects the done icon 178, the control system 100 may disregard any setpoint modes changes made via the system configuration GUI 174, for example, by maintaining and/or restoring the setpoint mode indicators previously stored in memory 88. Additionally, or alternatively, the control system 100 may determine that setpoint mode configuration has been completed once a threshold period of inactivity has elapsed.

On the other hand, when a user input detected during display of the system configuration GUI 174 does not indicate that setpoint mode configuration has been completed, the control system 100 may determine that the user input is requesting a change to a current setpoint mode a building zone 120 and, thus, adjust display of the system configuration GUI 174 on the electronic display 106 accordingly (process block 158). For example, when the user input selects a first setpoint mode icon 176A, the system configuration GUI 174 may change the first setpoint mode icon 176A from an un-shaded setpoint mode icon 182 to a shaded setpoint mode icon 183. Additionally or alternatively, when the user input selects a third setpoint mode icon 176C, the system configuration GUI 174 may change the third setpoint mode icon 176C from a shaded setpoint mode icon 183 to an un-shaded setpoint mode icon 183.

Figure 12:
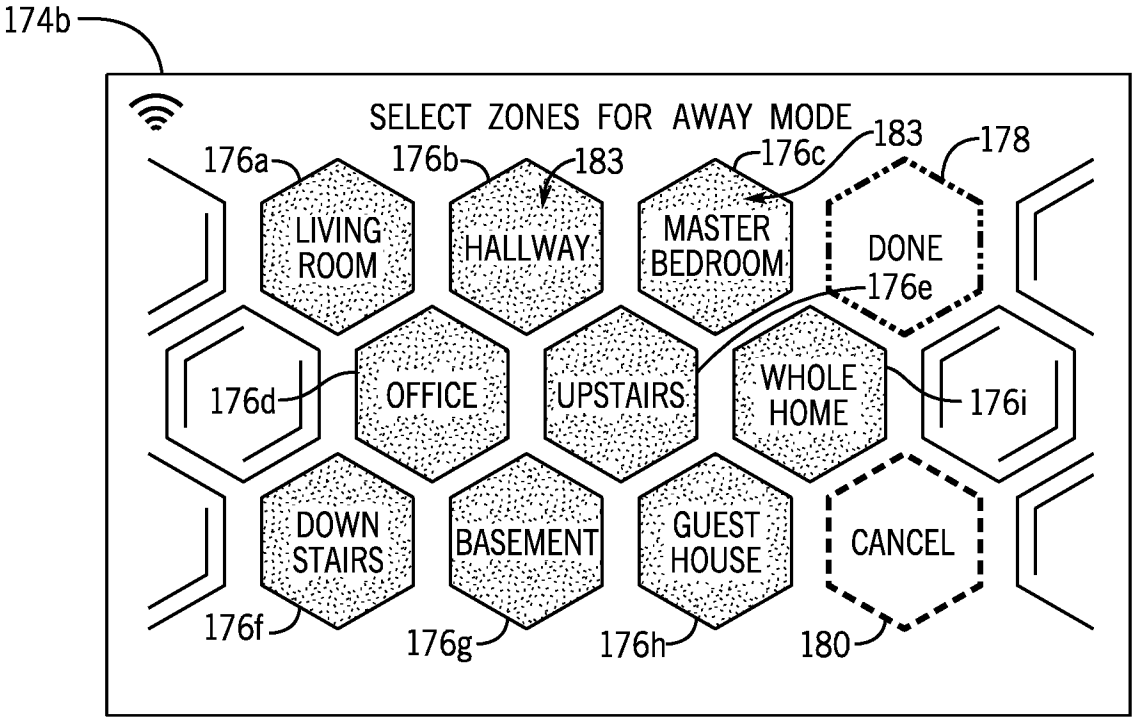
FIG. 12 is another example of a zone setpoint configuration graphical user interface (GUI) including a visual representation of another setpoint mode configuration of the multiple building zones, in accordance with an embodiment of the present disclosure.

To help further illustrate, another example of a system configuration GUI 174 is shown in FIG. 12. As depicted, each setpoint mode icon 176 on the system configuration GUI 174 is an un-shaded setpoint mode icon 183, thereby indicating that each building zone 120 is in the away mode. In some embodiments, a user input selecting a setpoint mode icon 176 corresponding with multiple building zones 120 may result in each of the building zones 120 being configured using the same setpoint mode. For example, a user input selecting the ninth setpoint mode icon 176I may result in each of the setpoint mode icons 176 being displayed as a shaded setpoint mode icon 182, thereby indicating that each building zone 120 is in the home mode.

Returning to the setpoint mode configuration process 146 of FIG. 9, after completion of the setpoint mode configuration, the control system 100 may instruct the electronic display 106 to resume displaying the zone overview GUI 164 associated with a corresponding building zone 120 (arrow 159). As described above, in some embodiments, a zone overview GUI 164 may include a current setpoint mode icon 170 that indicates a current setpoint mode of a corresponding building zone 120. Thus, when the current setpoint mode is changed, display of a corresponding current setpoint mode icon 170 may also be changed.

Figure 13:
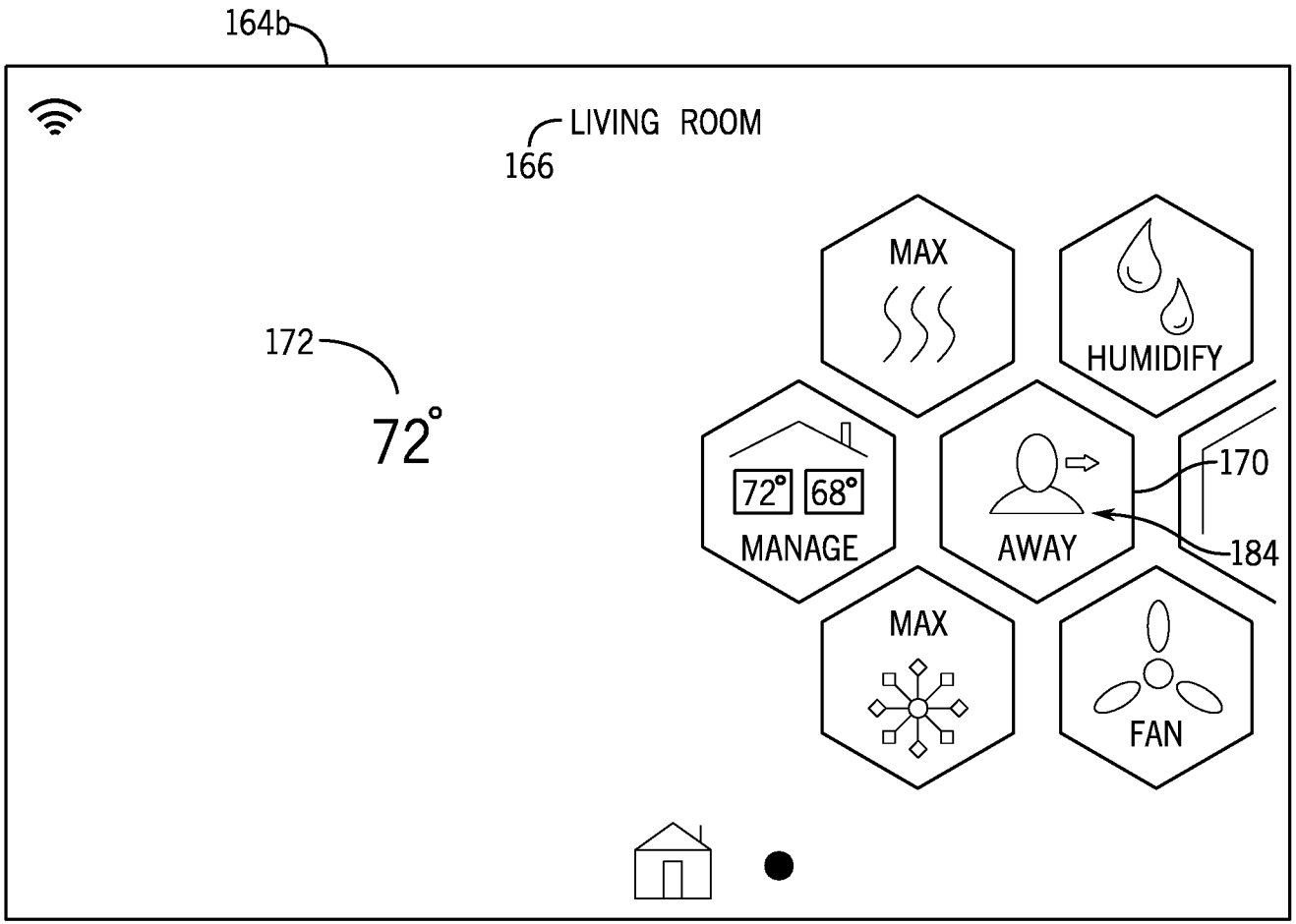
FIG. 13 is another example of the zone overview graphical user interface (GUI) including visual representation a current setpoint mode of a corresponding building zone, in accordance with an embodiment of the present disclosure.

To help illustrate, another example of a zone overview GUI 164B, which may be displayed on an electronic display 106, is shown in FIG. 13. As depicted, the zone overview GUI 164B of FIG. 13 and the zone overview GUI 164A of FIG. 10 both correspond to the same building zone 120. However, the current setpoint mode icon 170 included in the zone overview GUI 164B of FIG. 13 indicates that the building zone 120 is currently in the away mode while the current setpoint mode icon 170 included in the zone overview GUI 164A of FIG. 10 indicates that the building zone 120 is currently in the home mode. In other words, in some embodiments, a zone overview GUI 164 may adaptively adjust display of a current setpoint mode icon 170 in response to changes to a current setpoint mode of a corresponding building zone 120.

As described above, the present disclosure relates to enabling a user to configure setpoint modes for individual building zones and/or a whole system of building zones. At least in some instances, improving user customization may facilitate improving efficacy of a climate control system, for example, by enabling a user, such as a homeowner or a service technician, to selectively configure air condition setpoint modes for individual building zones. Additionally, at least in some instances, enabling a user to change a current setpoint mode for each of multiple building zone by toggle a button or icon associated with one or more building zones may facilitate reducing complexity of a configuration adjustment process. In this manner, the techniques described in the present disclosure may facilitate improving a configuration process, such as an initial setup configuration process and/or a subsequent configuration adjust process, of a climate control system, which, at least in some instances, may encourage user customization that facilitates achieving the target occupant comfort level and/or the target power consumption.

The specific embodiments described above have been shown by way of example. It should be understood that these embodiments may be susceptible to various modifications and/or alternative forms. It should be further understood that the claims are not intended to be limited to the particular forms disclosed, but rather to cover all modifications, equivalents, and alternatives falling within the spirit and scope of the present disclosure.

What is claimed is:

1. A control system of a heating, ventilation, and/or air conditioning (HVAC) system, comprising:

a graphical user interface (GUI) that simultaneously displays visual representations indicative of current setpoint modes of a plurality of building zones serviced by the HVAC system, wherein each visual representation of the visual representations identifies at least one building zone of the plurality of building zones; and a control circuitry communicatively coupled to the GUI, wherein the control circuitry is configured to:

in response to a user input, wherein the user input is a single selection of a first visual representation of the visual representations displayed by the GUI, and wherein the first visual representation is associated with a first building zone of the plurality of building zones, toggle between a home setpoint mode and an away setpoint mode as a first current setpoint mode of the first building zone; and operate the HVAC system to condition air supplied to the first building zone according to the first current setpoint mode.

2. The control system of claim 1, wherein the visual representations comprise a whole home icon indicative of a current setpoint mode of the plurality of building zones; and the control circuitry is configured to:

in response to an additional user input indicative of selection of the whole home icon, toggle the current setpoint mode of each building zone of the plurality of building zones between the home setpoint mode and the away setpoint mode; and operate the HVAC system to condition air supplied to each building zone of the plurality of building zones according to the current setpoint mode of the plurality of building zones simultaneously.

3. The control system of claim 1, comprising:

a first thermostat configured to determine a first temperature measured in the first building zone of the plurality of building zones, wherein the control circuitry is configured to control air flow supplied to the first building zone based on deviation of the first temperature relative to a first temperature setpoint associated with the first current setpoint mode of the first building zone; and a second thermostat configured to determine a second temperature measured in a second building zone of the plurality of building zones, wherein the control circuitry is configured to control air flow supplied to the second building zone based on deviation of the second temperature relative to a second temperature setpoint associated with a second current setpoint mode of the second building zone.

4. The control system of claim 3, comprising a zone control panel configured to:

control air flow supplied to the first building zone by controlling a damper position of a first air damper fluidly coupled to the first building zone; and control air flow supplied to the second building zone by controlling a damper position of a second air damper fluidly coupled to the second building zone.

5. The control system of claim 1, comprising an input device configured to receive the user input, wherein the control circuitry is configured to update a current setpoint mode based on the received user input.

6. The control system of claim 1, wherein, to control the operation of the HVAC system based on the first current setpoint mode of the first building zone, the control circuitry is configured to:

determine a first air condition setpoint associated with the first current setpoint mode of the first building zone; and operate HVAC equipment deployed in the HVAC system based on the first air condition setpoint associated with the first building zone.

7. The control system of claim 1, wherein the control circuitry is configured to update the first visual representation indicative of the first current setpoint mode of the first building zone in response to the user input.

8. The control system of claim 1, wherein the visual representations indicative of the current setpoint modes of the plurality of building zones are displayed on the GUI as soft buttons configured to receive the user input via interaction between a user and the GUI.

9. The control system of claim 1, wherein the control circuitry is configured to control operation of the HVAC system in response to receiving an additional user input indicative of a confirmation.

10. The control system of claim 1, wherein the control circuitry is configured to display an overview GUI associated with each building zone of the plurality of building zones.

11. The control system of claim 1, comprising memory configured to store a home temperature setpoint and an away temperature setpoint associated with each building zone of the plurality of building zones.

12. A method of operating a heating, ventilation, and/or air conditioning (HVAC) system, comprising:

determining, using control circuitry of the HVAC system, a first air temperature measured in a first building zone serviced by the HVAC system and a second air temperature measured in a second building zone serviced by the HVAC system;

instructing, using the control circuitry, an electronic display to display a graphical user interface (GUI) comprising a first soft button comprising a first visual representation identifying the first building zone and indicating that the first building zone is currently in a first current setpoint mode and a second soft button comprising a second visual representation identifying the second building zone and indicating that the second building zone is currently in a second current setpoint mode;

receiving, via an input device, a single user selection of the first soft button displayed on the GUI associated with the first building zone, wherein the single user selection causes toggling of the first current setpoint mode associated with the first building zone between a home setpoint mode and an away setpoint mode;

determining, using the control circuitry, the first current setpoint mode associated with the first building zone;

determining that the second current setpoint mode associated with the second building zone is a different current setpoint mode than the first current setpoint mode; and in response to determining that the first current setpoint mode is different from the second current setpoint mode:

determining a first temperature setpoint associated with the first building zone while in the first current setpoint mode and a second temperature setpoint associated with the second building zone while in the second current setpoint mode; and operating, using the control circuitry, the HVAC system to condition air flow supplied to the first building zone and the second building zone based on the first temperature setpoint relative to the first air temperature measured in the first building zone and based on the second temperature setpoint relative to the second air temperature measured in the second building zone.

13. The method of claim 12, comprising:

in response to user selection of the first soft button, switching, using the control circuitry, the first building zone from the home setpoint mode to the away setpoint mode; and in response to user selection of the second soft button, switching, using the control circuitry, the second building zone from the away setpoint mode to the home setpoint mode.

14. The method of claim 13, comprising:

instructing, using the control circuitry, the electronic display to display the GUI such that the GUI comprises a third soft button indicating that the home setpoint mode is associated with one or more building zones in a plurality of building zones; and in response to user selection of the third soft button, switching, using the control circuitry, the first building zone from the home setpoint mode to the away setpoint mode.

15. The method of claim 13, comprising:

instructing, using the control circuitry, the electronic display to display the GUI such that the GUI comprises a third soft button comprising a third visual representation indicating that the away setpoint mode is associated with one or more building zones in a plurality of building zones; and in response to user selection of the third soft button, switching, using the control circuitry, the second building zone from the away setpoint mode to the home setpoint mode.

16. The method of claim 13, comprising controlling, using the control circuitry, air flow supplied to the first building zone and the second building zone based on the first temperature setpoint associated with the first building zone when the first building zone is in the first current setpoint mode, the first air temperature measured in the first building zone, the second temperature setpoint associated with the second building zone when the second building zone is in the second current setpoint mode, and the second air temperature measured in the second building zone in response to receiving a user confirmation.

17. The method of claim 16, wherein controlling air flow supplied to the first building zone based on the first current setpoint mode and the second building zone based on the second current setpoint mode comprises:

instructing an HVAC unit to turn on when the first air temperature measured in the first building zone deviates from the first temperature setpoint associated with the first building zone by more than a threshold, in response to determining that the second air temperature measured in the second building zone deviates from the second temperature setpoint associated with the second building zone by more than the threshold, or both;

causing a first air damper fluidly coupled to the first building zone to transition to a first more open position in response to determining that the first air temperature measured in the first building zone deviates from the first temperature setpoint associated with the first building zone by more than the threshold; and causing a second air damper fluidly coupled to the second building zone to transition to a second more open position in response to determining that the second air temperature measured in the second building zone deviates from the second current setpoint mode associated with the second building zone by more than the threshold.

18. A heating, ventilation, and air conditioning (HVAC) system comprising a climate control system having:

a memory configured to store a first occupied temperature setpoint associated with a first building zone serviced by the HVAC system, a first unoccupied temperature setpoint associated with the first building zone, a second occupied temperature setpoint associated with a second building zone serviced by the HVAC system, and a second unoccupied temperature setpoint associated with the second building zone;

a user interface configured to display a graphical user interface (GUI) that simultaneously displays a first user selectable icon indicative of an operation mode of the first building zone, a second user selectable icon indicative of an operation mode of the second building zone, and a third user selectable icon indicative of an operation mode of the climate control system as a whole; and control circuitry communicatively coupled to the memory and the user interface, wherein the control circuitry is configured to:

receive a first user input to transition the climate control system from an occupied operation mode to an unoccupied operation mode, wherein the first user input is a first single user selection of the third user selectable icon of the GUI via the user interface:

based on receipt of the first user input, operate HVAC equipment based on the first unoccupied temperature setpoint associated with the first building zone and the second unoccupied temperature setpoint associated with the second building zone to condition air supplied to the first building zone and the second building zone simultaneously;

receive a second user input to transition the first building zone from the occupied operation mode to the unoccupied operation mode, wherein the second user input is a second single user selection of the first user selectable icon of the GUI via the user interface; and based on receipt of the second user input, operate the HVAC equipment based on the first unoccupied temperature setpoint associated with the first building zone to condition air supplied to the first building zone.

19. The HVAC system of claim 18, wherein the control circuitry is configured to:

operate the HVAC equipment based on the first occupied temperature setpoint associated with the first building zone and the second occupied temperature setpoint associated with the second building zone to condition the air supplied to the first building zone and the second building zone before the first single user selection of the third user selectable icon to transition the operation of the climate control system as a whole from the occupied operation mode to the unoccupied operation mode is received; and operate the HVAC equipment based on the first occupied temperature setpoint associated with the first building zone to condition the air supplied to the first building zone before the second single user selection of the first user selectable icon to transition the first building zone from the occupied operation mode to the unoccupied operation mode is received.

20. The HVAC system of claim 18, wherein the control circuitry is configured to:

receive a third user input that selects to transition the second building zone from the occupied operation mode to the unoccupied operation mode, wherein the third user input comprises user selection of the second user selectable icon via the user interface;

based on receipt of the third user input, operate the HVAC equipment based on the second unoccupied temperature setpoint associated with the second building zone to condition air supplied to second building zone; and control operation of the HVAC equipment based on the second occupied temperature setpoint associated with the second building zone before the third user input comprising user selection of the second user selectable icon to transition the second building zone from the occupied operation mode to the unoccupied operation mode is received.

21. The HVAC system of claim 18, wherein the control circuitry is configured to:

update a first visualization of the third user selectable icon after the first single user selection of the third user selectable icon to transition the operation of the climate control system as a whole is received; and update a second visualization of the first user selectable icon after the second single user selection of the first user selectable icon to transition the first building zone from the occupied operation mode to the unoccupied operation mode is received.

* * * * *